US005991565A

United States Patent [19]

Hanyu et al.

[11] Patent Number: 5,991,565

[45] Date of Patent: Nov. 23, 1999

[54] FIXING DEVICE

[75] Inventors: Naohiko Hanyu; Takeichi Shimada; Yoshiko Matsuoka, all of Hachioji, Japan

[73] Assignee: Konica Corporation, Tokyo, Japan

[21] Appl. No.: 09/209,021

[22] Filed: Dec. 10, 1998

[30] Foreign Application Priority Data

Dec. 16, 1997 [JP] Japan ..... 9-346228
Dec. 22, 1997 [JP] Japan ..... 9-352780

[51] Int. Cl.[6] ..... G03G 15/20

[52] U.S. Cl. ..... 399/69; 399/328; 399/330

[58] Field of Search ..... 399/45, 67, 69, 399/91, 94, 97, 320, 324, 325, 328, 330, 333, 334; 219/216

[56] References Cited

U.S. PATENT DOCUMENTS 5,001,519 3/1991 Saito ..... 399/69
5,550,621 8/1996 Ogawahara ..... 399/69
5,561,512 10/1996 Fukano et al. ..... 399/69
5,787,321 7/1998 Nishikawa et al. ..... 399/69
5,862,437 1/1999 Kutsuwada et al. ..... 399/97 X

*Primary Examiner*—Sandra Brase
*Attorney, Agent, or Firm*—Frishauf, Holtz, Goodman, Langer & Chick, P.C.

[57] ABSTRACT

In a device for fixing a toner image, provided with a heating roller including a heater, the heating roller having a length larger than a possible largest size sheet to be fixed so that the heating roller has an excess portion on which a small size sheet does not pass over; a pressing roller for coming in contact with the heating roller; and a cooling roller for coming in contact with the excess portion of the heating roller so as to cool the excess portion; one of the heating roller and the cooling roller is a metal roller and the other one is a roller comprising an elastic material layer.

11 Claims, 26 Drawing Sheets

FIG. 18 (a)

| A NUMBER OF COPY SHEETS WHEN COOLING MEANS STARTS CONTACTING | | | | | | | |
|---|---|---|---|---|---|---|---|
| A3 | B4 | A4 | B5 | A4R | B5R | A5R | B6 |
| — | 30 | — | 60 | 40 | 30 | 20 | 10 |

FIG. 18 (b)

| COOLING MEANS ROTATING DRIVING TIME (min) | | | |
|---|---|---|---|
| - 20 AFTER COPYING FINISHED | 21 - 50 AFTER COPYING FINISHED | 51 - 100 AFTER COPYING FINISHED | 101 - AFTER COPYING FINISHED |
| 2 | 4 | 7 | 10 |

| AMBIENT TEMPERATURE | CHILLING MEANS DRIVING STARTING COPY SETTING SHEET NUMBER (I) | | | | | | | |
|---|---|---|---|---|---|---|---|---|
| | A3 | B4 | A4 | B5 | A4R | B5R | A5 | B6 |
| 25℃ OR HIGHER | — | 35 | | 70 | 45 | 25 | 15 | 10 |
| 10℃ OR HIGHER AND LESS THAN 25℃ | — | 30 | — | 60 | 40 | 30 | 20 | 10 |
| LESS THAN 10℃ | — | 25 | — | 50 | 35 | 35 | 25 | 15 |

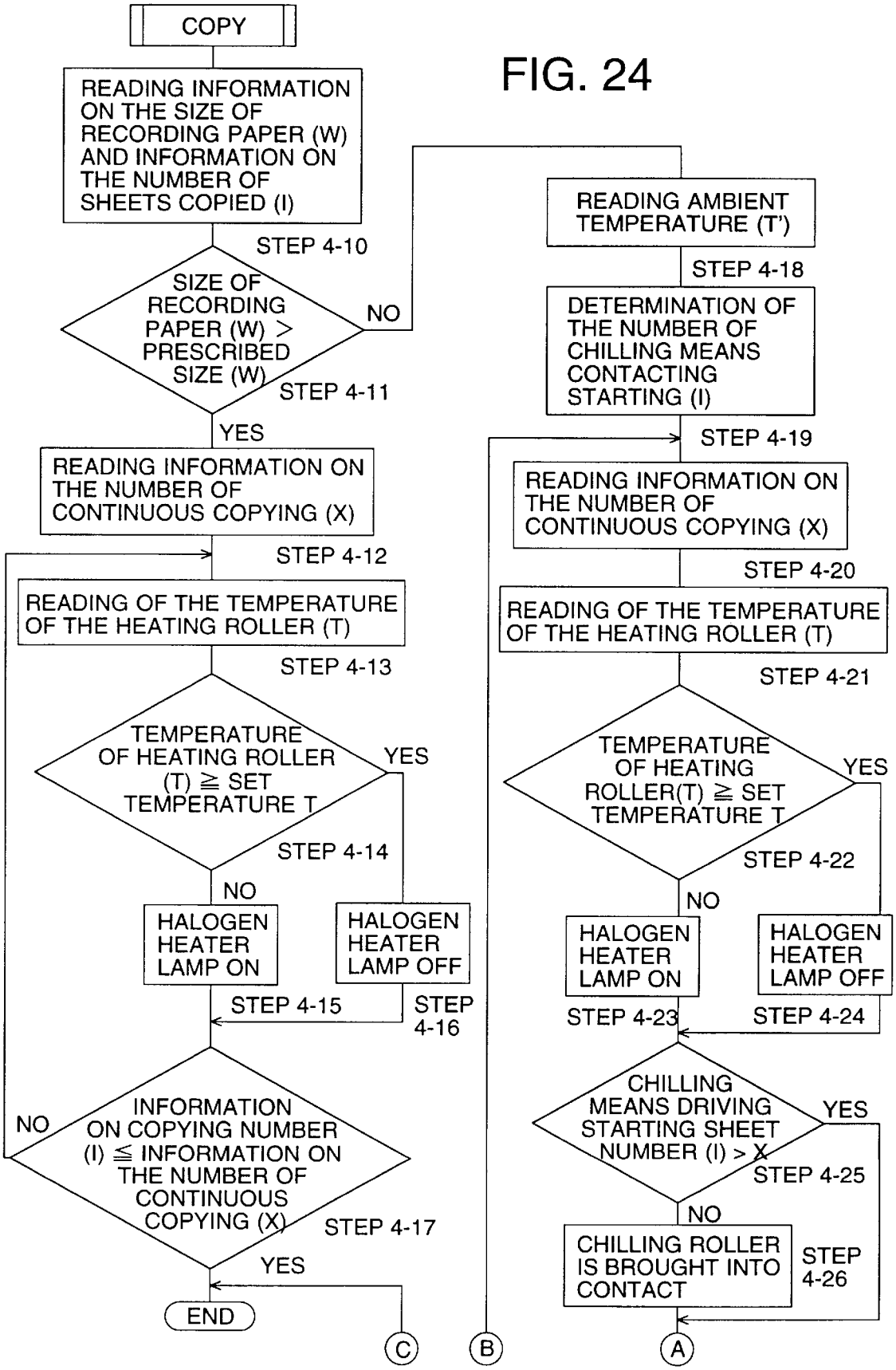
FIG. 24
COPY
READING INFORMATION ON THE SIZE OF RECORDING PAPER (W) AND INFORMATION ON THE NUMBER OF SHEETS COPIED (I)
STEP 4-10
SIZE OF RECORDING PAPER (W) > PRESCRIBED SIZE (W)
NO
STEP 4-11
YES
READING INFORMATION ON THE NUMBER OF CONTINUOUS COPYING (X)
STEP 4-12
READING OF THE TEMPERATURE OF THE HEATING ROLLER (T)
STEP 4-13
TEMPERATURE OF HEATING ROLLER (T) ≧ SET TEMPERATURE T
YES
STEP 4-14
NO
HALOGEN HEATER LAMP ON
HALOGEN HEATER LAMP OFF
STEP 4-15
STEP 4-16
INFORMATION ON COPYING NUMBER (I) ≦ INFORMATION ON THE NUMBER OF CONTINUOUS COPYING (X)
NO
STEP 4-17
YES
END
C
B
READING AMBIENT TEMPERATURE (T')
STEP 4-18
DETERMINATION OF THE NUMBER OF CHILLING MEANS CONTACTING STARTING (I)
STEP 4-19
READING INFORMATION ON THE NUMBER OF CONTINUOUS COPYING (X)
STEP 4-20
READING OF THE TEMPERATURE OF THE HEATING ROLLER (T)
STEP 4-21
TEMPERATURE OF HEATING ROLLER(T) ≧ SET TEMPERATURE T
YES
STEP 4-22
NO
HALOGEN HEATER LAMP ON
HALOGEN HEATER LAMP OFF
STEP 4-23
STEP 4-24
CHILLING MEANS DRIVING STARTING SHEET NUMBER (I) > X
YES
STEP 4-25
NO
CHILLING ROLLER IS BROUGHT INTO CONTACT
STEP 4-26
A

FIXING DEVICE

BACKGROUND OF THE INVENTION

The present invention relates to a fixing device composed of a heating roller having a heating means and a pressure roller which is brought to pressure contact with aforesaid heating roller, wherein a transfer sheet on which a toner image is transferred is passed between aforesaid heating roller and pressure roller so that the above-mentioned toner image is subjected to heat fixing on the above-mentioned transfer sheet.

FIG. 27 shows a block diagram of a conventional fixing device.

In FIG. 27, numeral 1 represents a heating roller having heating means 2 inside thereof, and numeral 3 represents a pressure roller which is brought into contact with heating roller 1.

Due to that the transfer sheet on which the toner image has been transferred passes heating roller 1 and pressure roller 3, the toner image is thermally fixed on the transfer sheet.

The fixing device can fix plural kinds of transfer sheets having different sizes of width, for example, a transfer sheet having a width L and a transfer sheet having a width L'.

In the fixing device having the above-mentioned constitution, for example, if a under-sizedd transfer sheet having a width L' is continuously fixed, there is a possibility that the temperature in the non-passing portion (Lout) of the under-sizedd transfer sheet rises and hot offset occurs.

In order to prevent aforesaid hot offset, cooling roller 4 provided on both ends of heating roller 1 contactably/separably is provided.

When fixing the under-sizedd transfer sheet, cooling roller is brought into contact with heating roller 1 and portions out of the passing region of the under-sizedd transfer sheet is cooled.

In the above-mentioned conventional fixing device, if the heating roller is a hard roller laminated with a fluorine-containing resin on a metallic roller substrate and the cooling roller is a metal roller, there is a possibility that the contact area between the heating roller and the cooling roller is narrow so that sufficient cooling is prevented. Accordingly, hot offset easily occurs.

If the temperature of the roller raises to the extent that hot offset occurs, there occurs another problem that the life of parts around the heating roller is shortened.

In addition, the temperature on the surface of the cooling roller is lower than the heating roller. Accordingly, contamination on the heating roller easily transfers on the surface of the cooling roller.

SUMMARY OF THE INVENTION

The present invention was attained considering the above-mentioned problems. An objective of the invention is to provide a fixing device in which hot offset is difficult to occur.

The above objective can attained by the following structure.

A device for fixing a toner image, comprises a heating roller including a heater, the heating roller having a length larger than a possible largest size sheet to be fixed so that the heating roller has an excess portion on which a small size sheet does not pass over;

a pressing roller for coming in contact with the heating roller; and a cooling roller for coming in contact with the excess portion of the heating roller so as to cool the excess portion;

wherein one of the heating roller and the cooling roller is a metal roller and the other one is a roller comprising an elastic material layer.

Further, the object of the present invention can be attained by preferable structures described in each of the following items.

(1) A structure described in Item 1 for solving the above-mentioned problem is a fixing device provided with a heating roller having a heating means, a pressure roller which is brought into pressure contact with aforesaid heating roller and a cooling member provided in such a manner as to contact the region out of the passing region of the minimum sized transfer sheet of the above-mentioned heating roller, wherein a metal roller is used as the above-mentioned heating roller and a roller having an elastic material layer is used on the outer circumference.

Since the cooling roller, functioning as a cooling member, has an elastic layer on the outer circumference, the contact area between the heating roller and the cooling member is broadened. Accordingly, cooling of the heating roller can be conducted and the occurrence of hot offset can be prevented.

In addition, the rise of the temperature out of the passing region of the under-sizedd transfer sheet can be prevented. Accordingly, life of parts in the vicinity of the heating roller is extended.

(2) A structure described in Item 2 is a fixing device, wherein the heat conductivity of the above-mentioned elastic material layer of the structure described in Item 1 is 0.16 W/mK or more.

Due to controlling the heat conductivity of the above-mentioned elastic material layer at 0.16 W/mK or more, sufficient cooling of the heating roller can be conducted. Therefore, the occurrence of the hot offset can be prevented and life of parts in the vicinity of the heating roller can be extended.

(3) A structure described in Item 3 is a fixing device provided with a heating roller having a heating means, a pressure roller which is brought into pressure contact with aforesaid heating roller and a cooling member provided in such a manner as to contact the region out of the passing region of the minimum sized transfer sheet within the passing region of the above-mentioned heating roller for the maximum sized transfer sheet, wherein a roller having an elastic material layer on the outer circumference thereof is used and a metal roller is used as the above-mentioned cooling member is used.

Since the heating roller has an elastic layer on the outer circumference, the contact area between the heating roller and the metal roller, as the cooling member, is broadened. Since the metal roller having high heat transmissivity was used as the cooling member, sufficient cooling of the heating roller can be conducted and the occurrence of hot offset can be prevented.

In addition, temperature rise out of the passing region of the transfer sheet having small size can be prevented. Therefore, life of parts in the vicinity of the heating roller is extended.

(4) A structure described in Item 4 is a fixing device provided with a heating roller having a heating means, a pressure roller which is brought into pressure contact with aforesaid heating roller and a cooling member provided in such a manner as to contact the region out of the passing region of the minimum sized transfer sheet on the above-mentioned heating roller, wherein a release material is coated on the surface of the above-mentioned heating roller and the contact angle by means of the above-mentioned release material on the surface of the above-mentioned cooling member is larger than the contact angle by means of the above-mentioned release material on the surface of the above-mentioned heating roller.

Since the parting property of the cooling member is superior to the heating roller, due to that the contact angle by means of the above-mentioned release material on the surface of the above-mentioned cooling member is larger than the contact angle by means of the release material on the surface of the heating roller, contamination on the heating roller is difficult to adhere on the cooling member.

Accordingly, contamination is not deposited on the surface of the cooling roller and the contact between the heating roller and the cooling roller is always secured. Whereby cooling efficiency is not lowered.

(5) A structure described in Items 1 to 4 is a fixing device in which the cooling member can come in contact with or move away from the heating roller.

When the cooling is not required, the cooling member is moved away from the heating roller. Accordingly, the heated cooling member can be rapidly cooled down so that the cooling efficiency is not lowered. Further, the contamination coming from the heating roller can be reduced.

BRIEF EXPLANATION OF THE DRAWINGS

FIGS. 18(*a*) and 18(*b*) show a drawing explaining information recorded om the look-up table shown in FIG. 17.

FIG. 22 shows a block diagram explaining electrical constitution of the fixing device shown in FIG. 21.

FIG. 24 shows a flow diagram showing control of the fixing device during copying operation in FIG. 22.

DETAILED DESCRIPTION OF THE PREFERRED EMBODIMENT

Next, first through third embodiments of the present invention will be explained referring to drawings.

Figure 8:
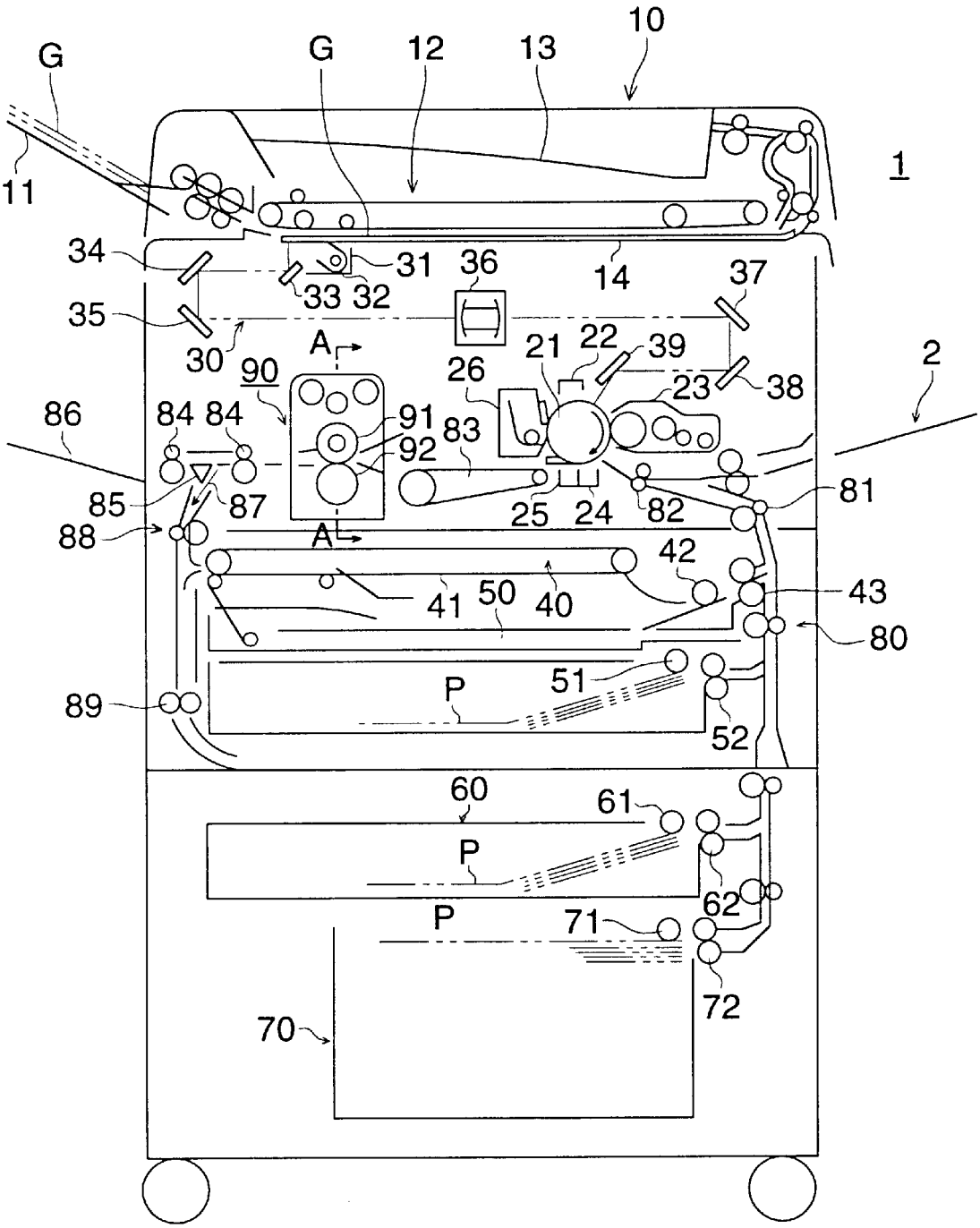
FIG. 8 shows an overall block diagram of an image forming apparatus in which a fixing device of the first through third embodiments are provided.

First, overall constitution and operation of an image forming apparatus in which a fixing device of first through third examples of the embodiment is provided will be explained referring to FIG. 8. Incidentally, here, a copying machine will be used as an example of the image forming apparatus for explanation.

On the upper portion of image forming apparatus 1, automatic document feeding device 10 is provided. Document G set on document loading tray 11 is fed onto document loading plate 14 by means of conveyance mechanism 12. document G loaded on aforesaid document loading plate 14 is discharged to document receiving section 13 by means of conveyance mechanism 12 at the timing of exposure end.

Inside image forming apparatus 1, on the outer circumference of drum-shaped photoreceptor 21, which is an image forming means, charger 22, developing device 23, transfer device 24, separation device 25 and cleaning device 26 are located in accordance with their functions. Aforesaid devices are formed integrally as an image forming unit.

After providing electrical charges on the surface of photosensitive layer of photoreceptor 21 by the use of charger 22, light exposure is started on document G loaded on document loading plate 14 provided on the uppermost portion of image forming apparatus 11 by the use of exposure lamp 32 provided inside optical frame 31 of light exposure unit 30.

Light is exposed from the arrowed direction through mirror 33 which moves integrally with exposure lamp 32, V-shaped mirrors 34 and 35 which move half distance of the movement distance of aforesaid mirror 33, V-shaped mirrors 37 and 38 wherein image-forming lens 36 is located between mirrors 34 and 35 and mirrors 37 and 38 and mirror 39 which irradiates an image on photoreceptor 21. on the photosensitive layer surface of photoreceptor 21, electrostatic latent image is formed.

Next, electrostatic latent image is developed in developing device 23 inside image forming unit 20. On the surface of photosensitive layer of photoreceptor 21, visible image by means of toner image is formed.

In addition, on the lower portion of image forming apparatus 1, double-sided copying paper feeding unit 40 and paper feeding units 50, 60 and 70 are located vertically. In paper feeding units 50, 60 and 70, different sizes of recording paper P, used as transfer sheets, are housed.

In the embodiment of the present invention, two modes, i.e., an automatic mod e which detects the size of document loaded on document loading plate 14 and automatically selects recording paper P relevantly and a manual mode in which an operator selects recording paper P by the use of a selection switch for recording paper P provided on an operation panel, are provided.

In addition, information about the size of recording paper P selected is sent to control section 500 described later.

When recording paper P housed in paper feeding unit 50 is selected, only one sheet of recording paper P is fed by means of paper feeding roller 51. Aforesaid recording paper P is conveyed by the use of guiding roller 52.

Similarly, when recording paper P housed in paper feeding unit 60 or 70 is selected, only one sheet of recording paper P is fed by means of paper feeding roller 61 or 71. Aforesaid recording paper P is conveyed by the use of guiding roller 62 or 72.

Recording paper P is conveyed to photoreceptor 21 on which toner images are formed, through conveyance path 80 by means of conveyance mechanism 81. Recording paper P is force to temporarily stop by means of registration roller 82 provided in image forming apparatus 1. Paper feeding is conducted in such a manner that toner images formed on photoreceptor 21 coincides with recording paper P.

Next, toner images on photoreceptor 21 is transferred onto recording paper P by means of transfer device 24. Aforesaid recording paper P is withdrawn from the surface of photoreceptor 21 by means of separation device 25. Recording paper P is conveyed to fixing device 90 by means of conveyance device 83.

Fixing device 90 is equipped with heating roller 91 and pressure roller 92 which is brought into contact with aforesaid heating roller 91. Due to that recording paper P on which toner image is transferred is fixed between heating roller 91 and pressure roller 92, toner images are thermally fixed on recording paper P.

Recording paper P in which fixing is finished is ejected by means of paper ejecting guiding roller 84. In the case of one-sided copying, paper ejecting switching member 85 falls. As it is, recording paper P is ejected on paper ejecting tray 86.

In the case of double-sided copying, paper ejecting switching member 85 rises. Recording paper guiding section 87 is opened. Recording paper P is conveyed to the dashed arrowed line.

In addition, recording paper P is conveyed downward by means of conveyance mechanism 88. By means of recording paper reversing section 89, aforesaid recording paper P is caused to switch back. The trailing end of recording paper P becomes the leading end thereof to be conveyed into double-sided copying paper feeding unit 50.

Recording paper P moves toward paper feeding direction by means of conveyance belt 41 provided on double-sided copying use paper feeding unit 50. By means of paper feeding roller 42, recording paper P is fed again. By means of conveyance roller 43, recording paper P is guided to conveyance path 80.

As described above, recording paper P is conveyed to the direction of photoreceptor 21 again. On the rear surface of recording paper P, toner images are transferred. At fixing device 90, the toner image is fixed. Then, recording paper P is ejected onto paper ejection tray 86. Incidentally, in addition to the above-mentioned paper feeding procedure, manual paper feeding device 2 which conducts paper feeding manually is also provided in image forming apparatus 1.

First Embodiment

Figure 1:
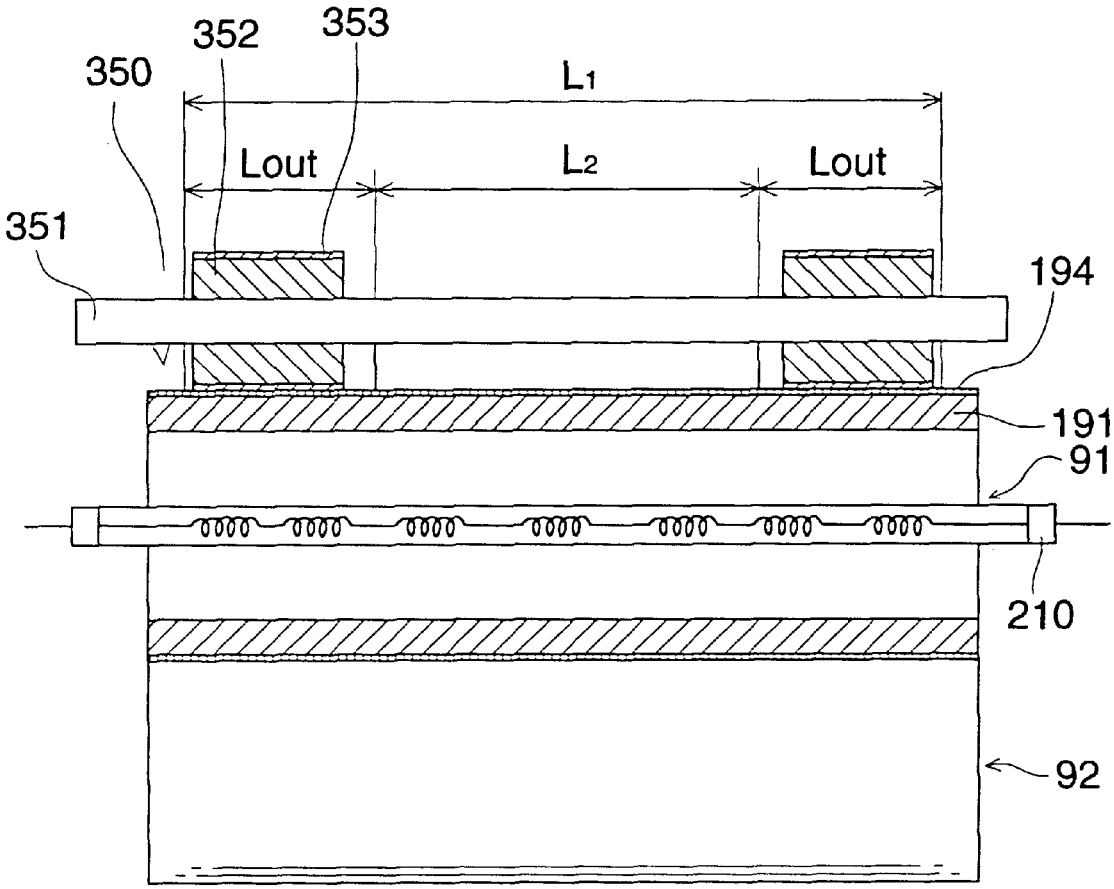
FIG. 1 shows a block diagram of the fixing device of the first embodiment and a cross sectional view of cutting line A—A in FIG. 8.

Next, a fixing device of the first embodiment will be explained, referring to FIG. 1. FIG. 1 shows a cross sectional view of cutting line A—A in FIG. 8 which is an overall block diagram of an image forming apparatus of embodiment of the present invention.

In heating roller 91, numeral 191 represents a cylindrical metal layer (metal roller substrate) made of metal cylinder (aluminum alloy) in which both ends are opened.

Inside cylindric al metal layer 191, halogen heater lamp 210, functioning as a heating source, is provided. On the outer circumference of cylindrical metal layer 191, fluorine-resin layer 194, functioning as a parting layer, is formed.

Incidentally, in the present embodiment, a halogen heater lamp was used as a heating source. A resistrative heating layer may be formed on the outer circumference or inner circumference of the heating roller.

Numeral 350 represents a cooling roller, functioning as a cooling member, provided in such a manner as to contact a region (Lout: hereinafter, non-passing portion (Lout)) other than the passing region of minimum size recording paper (L2), for example, A4R inside the passing region of the maximum size recording paper P (L1), such as A3R or A4 of heating roller 91.

Cooling roller 350 is composed of shaft 351 and silicone rubber layer 352 which is formed on shaft 351 and which functions as an elastic member layer being brought into contact with the non-passing portion (Lout) of heating roller 91. On the outer circumference of aforesaid silicone rubber layer 352, fluorine resin layer 353, functioning as a parting layer, is formed.

Incidentally, in the present embodiment, silicone rubber layer 352 was used as an elastic member layer. However, any materials can be used, provided that it is an elastic member having heat conductivity of 0.16 W/mK or more. For example, fluorine rubber may be used.

According to the fixing device of the above-mentioned constitution, the layer thickness of fluorine resin layer 353 formed on the outer circumference of cooling roller 350, functioning as a cooling member, is thin. Therefore, aforesaid fluorine resin layer 353 can be regarded as an elastic material layer in combination with silicone rubber layer 352. Contacting area between heating roller 91 and cooling roller 350 becomes wide. Accordingly, cooling of non-passing portion (Lout) of heating roller 350 can be conducted.

Due to controlling the heat conductivity of silicone rubber layer 352 be 0.16 W/mK or more, non-passing portion (Lout) of heating roller can further be cooled.

Accordingly, the occurrence of hot-offset can be minimized. In addition, temperature rise in non-passing portion (Lout) can be minimized. Accordingly, life time of parts in the vicinity of heating roller can be extended.

Second Embodiment

Figure 2:
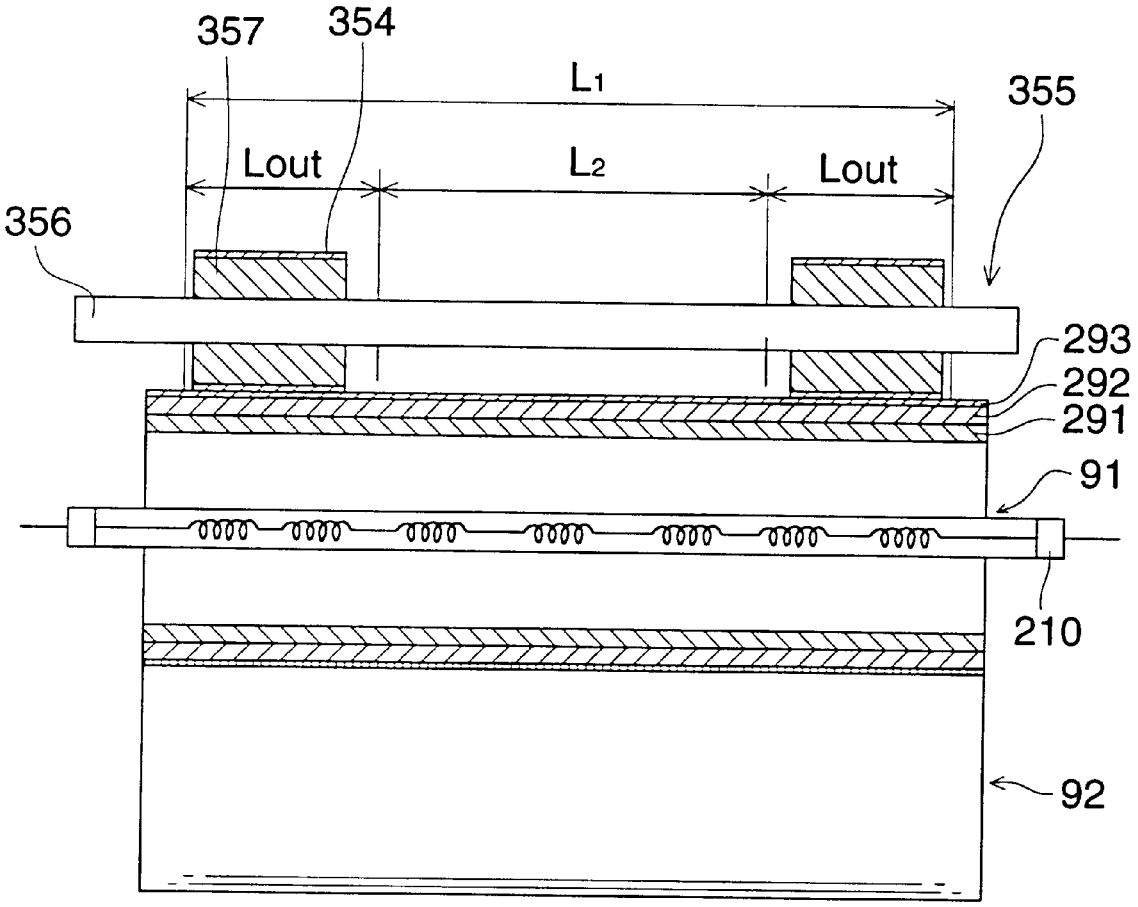
FIG. 2 shows a block diagram of the fixing device of the second embodiment and a cross sectional view of cutting line A—A in FIG. 8.

Next, a fixing device of the second embodiment will be explained referring to FIG. 2. FIG. 2 shows a cross sectional view of cutting line A—A in FIG. 8 which is an overall block diagram of an image forming apparatus of embodiment of the present invention.

In heating roller 91, numeral 291 represents a cylindrical metal layer (metal roller substrate) made of metal cylinder (aluminum alloy) in which both ends are opened.

Inside cylindrical metal layer 291, halogen heater lamp 210, functioning as a heating source, is provided. On the outer circumference of cylindrical metal layer 291, silicone rubber layer 292 and fluorine-resin layer 293 are formed.

Incidentally, in the present embodiment, a silicone rubber layer 352 was used as an elastic member layer. However, there is no limitation to the kind of the material provided that it is an elastic member having heat conductivity of 0.16 W/mK or more.

Numeral 355 represents a cooling roller, functioning as a cooling member, provided in such a manner as to contact a region (Lout: hereinafter, non-passing portion (Lout)) other than the passing region of minimum size recording paper (L2), for example, A4R inside the passing region of the maximum size recording paper P (L1), such as A3R or A4 of heating roller 91.

Cooling roller 355 is composed of shaft 356 and metal roller section 357 which is formed on shaft 356 and which is brought into contact with the non-passing portion (Lout) of heating roller 91. On the outer circumference of aforesaid metal roller section 357, fluorine resin layer 354 is formed.

According to the fixing device of the above-mentioned constitution, the layer thickness of fluorine resin layer 354 formed on the outer circumference of metal roller section 357 of cooling roller 350, functioning as a cooling member, is thin. Therefore, aforesaid fluorine resin layer 354 can be regarded as a metal roller section. Contacting area between heating roller 91 and metal roller section 357 as a cooling member becomes wide. Due to this, heating roller can be cooled. In addition, heating roller 91 can be sufficiently cooled due to using metal roller 357 having high heat conductivity as a cooling member.

Accordingly, the occurrence of hot-offset can be minimized. in addition, temperature rise in non-passing portion (Lout) can be minimized. Accordingly, life time of parts in the vicinity of heating roller can be extended.

Third Embodiment

Figure 3:
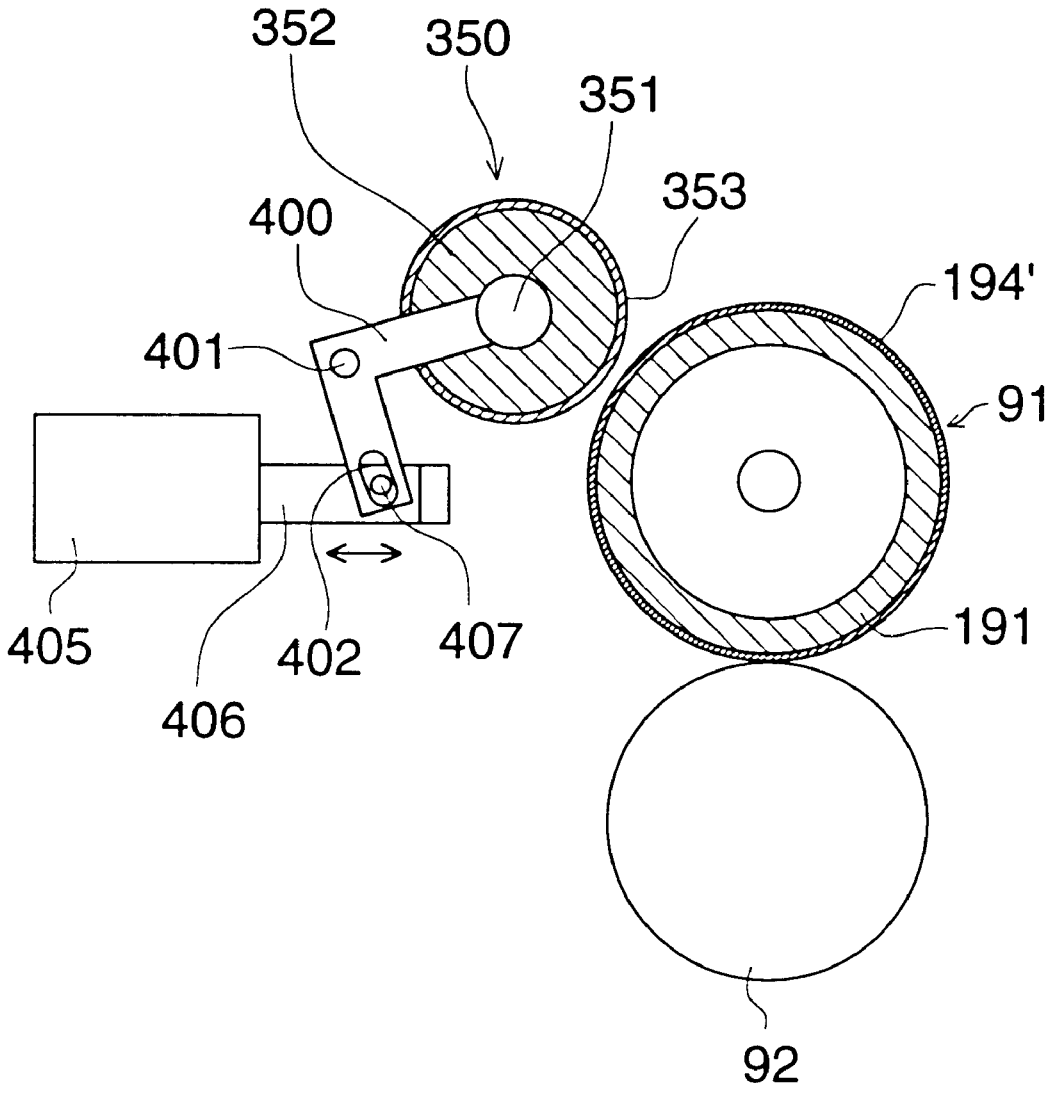
FIG. 3 is a block diagram of the main portion of the fixing device shown in FIG. 3.

Next, a fixing device of the third embodiment will be explained referring to FIG. 3. FIG. 3 shows a cross sectional block diagram of the main portion of the fixing device of the present embodiment.

Incidentally, in the present embodiment, those which is identical to the first embodiment are affixed with the same numerals. Explanation therefor will be omitted.

A significant different point between the embodiment of the present invention and the first embodiment is that cooling roller 350 can be brought into contact/withdrawn against heating roller 91 in the present embodiment though, in the first embodiment, cooling roller 350 is fixed and constantly brought into contact with heating roller 91.

In FIG. 3, numeral 400 is an approximately L-shape lever rotatably provided on pin 401. At one end of aforesaid lever 400, shaft 351 of cooling roller 350 is fixed. At the other end, elongated hole 402 is provided.

Pin 407 provided on spindle 406 on solenoid 405 is engaged with elongated hole 402 of lever 400.

Accordingly, due to driving solenoid 405, lever 400 rotates with pin 401 as the center. Silicone rubber layer 352 on cooling roller 350 is controlled to contact/separate from the non-passing portion (Lout) of heating roller 91.

On the outer circumference of heating roller 91, PFA ((tetrafluoroethylene/perfluoroalkyl vinyl ether copolymer)) 194', functioning as a parting layer, is formed.

On the outer circumference of heating roller 91, silicone oil is coated as a release material. On the outer circumference of silicone rubber 352 on cooling roller 350 of the present embodiment, fluorine resin layer 353 is formed as a release material. Contact angle by means of fluorie resin layer 353 is larger than the contact angle by means of the release material for PFA layer 194' on the surface of heating roller 91.

If the fluorine rubber or a silicone rubber is used as a parting layer for heating roller 91, the PFA layer is preferable as a parting layer for cooling roller 350.

Figure 4:
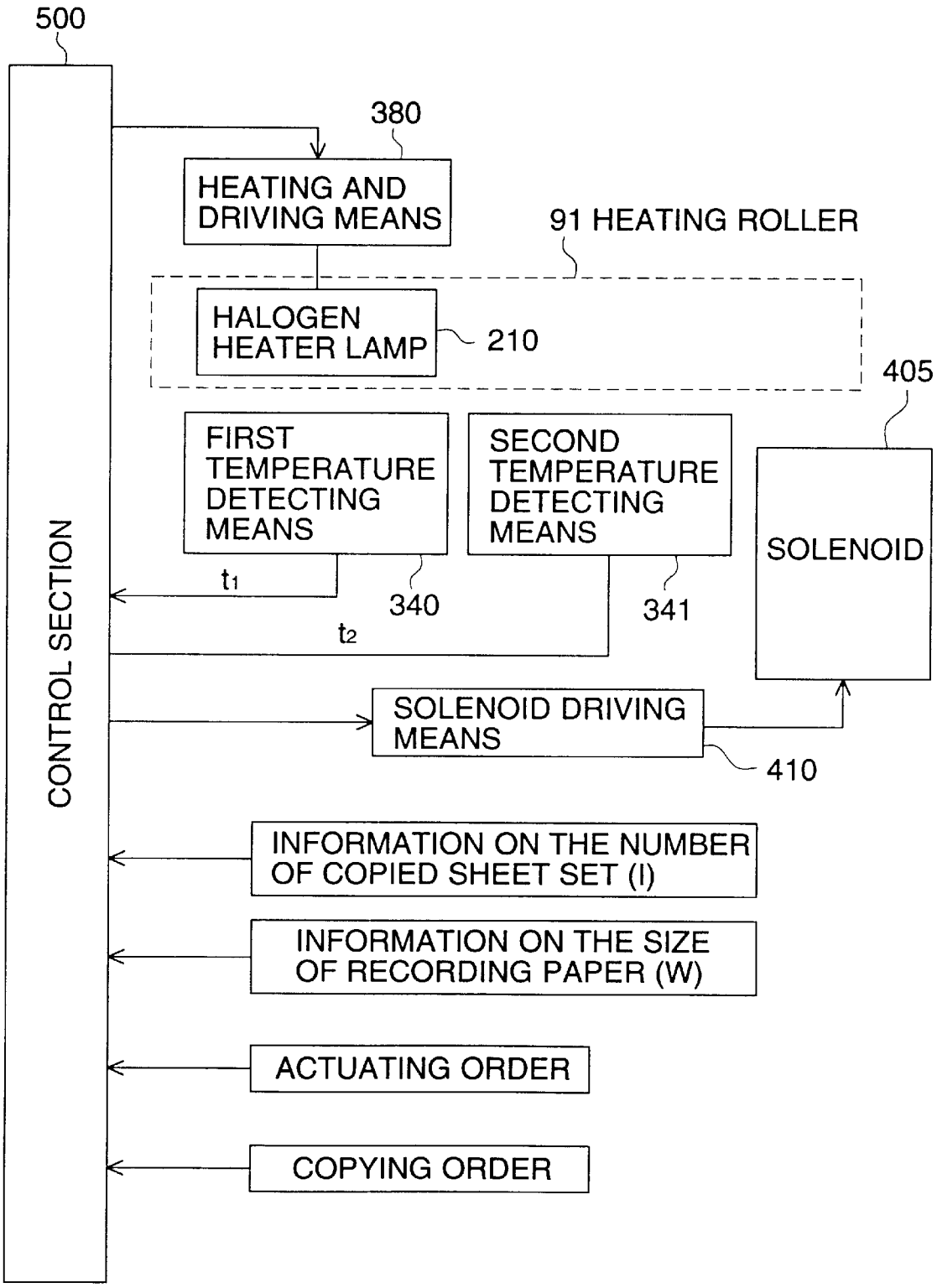
FIG. 4 shows a block diagram explaining electrical constitution of the fixing device shown in FIG. 3.

Next, using FIG. 4, an electrical constitution of the fixing device of the third embodiment will be explained. FIG. 4 is a block diagram explaining an electrical constitution of the fixing device shown in FIG. 3.

In FIG. 4, numeral 380 represents a heating and driving means composed of a circuit which drives halogen heater lamp 210 and numeral 410 represents a solenoid driving means composed of a circuit which drives solenoid 405.

Numeral 500 is a control section which obtains temperature information (t1) from first temperature detecting means 340 which detects temperature of the passing region of the minimum size recording paper of heating roller 91, temperature information (t2) from second temperature detecting means 341 which detects the temperature of non-passing portion (Lout) of heating roller 91, a driving order sent from an image forming apparatus main body when the power supply switch for the image forming apparatus main body is turned ON, a copying order sent from an image forming apparatus main body when the power supply switch for the image forming apparatus main body is turned ON, information about the size of recording paper (w) and information about the set copying sheet. Numeral 500 drives halogen heater lamp 210 through heating and driving means 380 and solenoid 405 through solenoid driving means 410.

Figure 5:
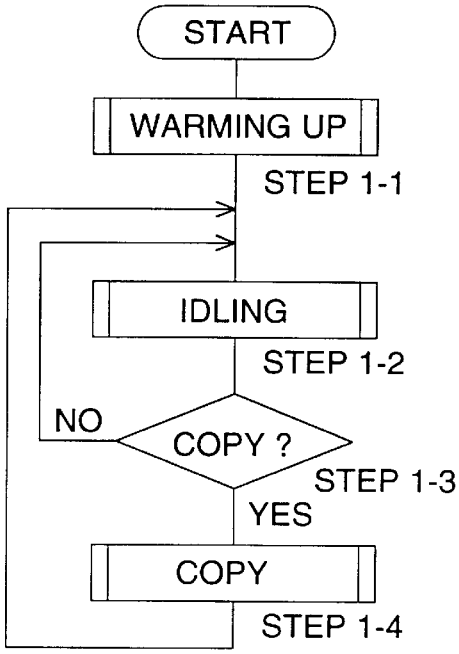
FIG. 5(*a*) shows a flow diagram explaining overall explanation of an image forming apparatus, FIG. 5(*b*) shows a flow diagram explaning warming up operation in FIG. 5(*a*) and FIG. 5(*c*) shows a flow diagram explaining idling operation in FIG. 5(*b*).
Figure 5:
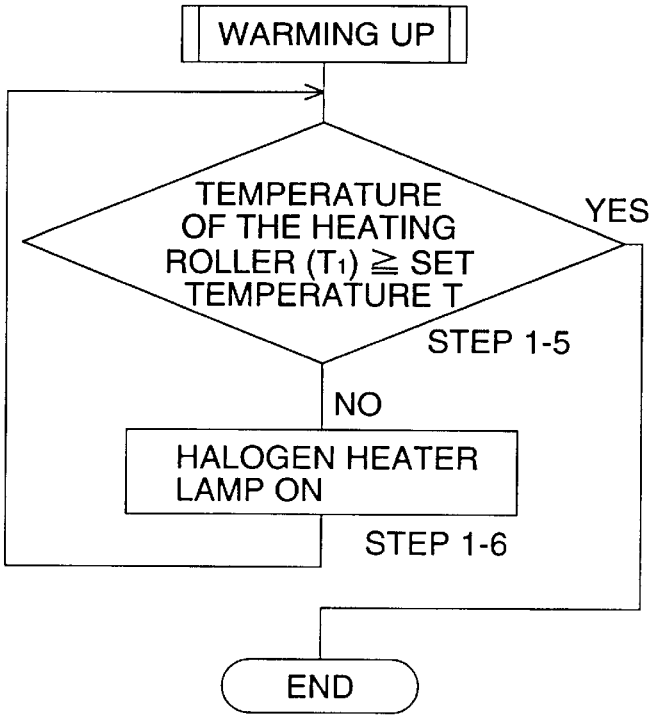
Figure 5:
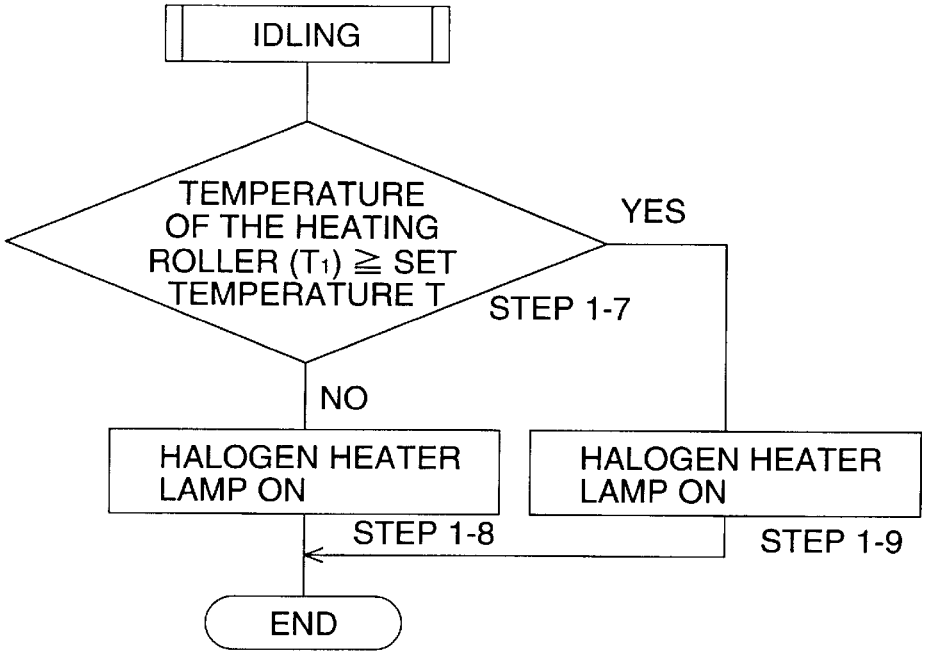
Figure 6:
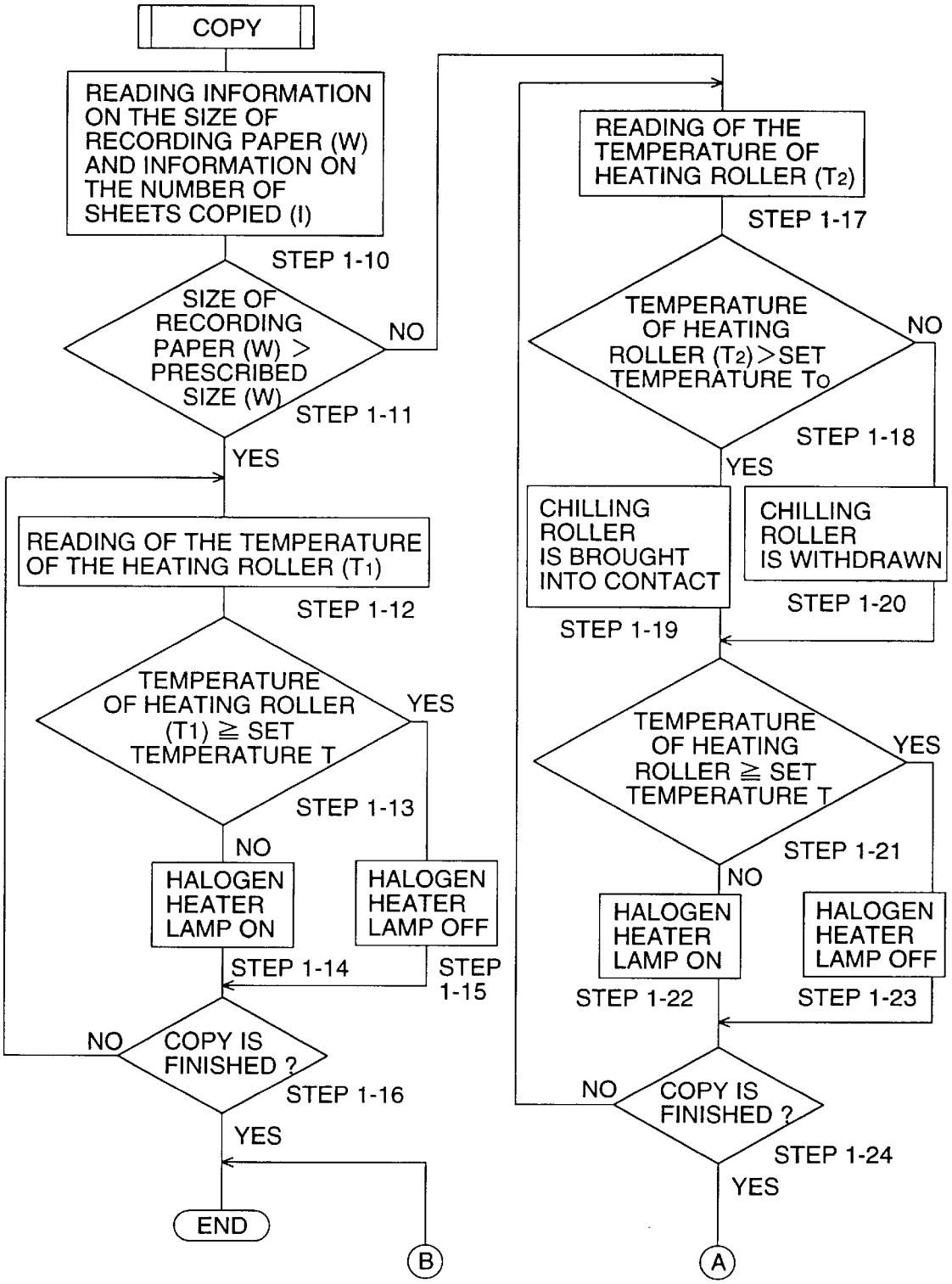
FIG. 6 shows a flow diagram showing control of the fixing device during copying operation in FIG. 1.
Figure 7:
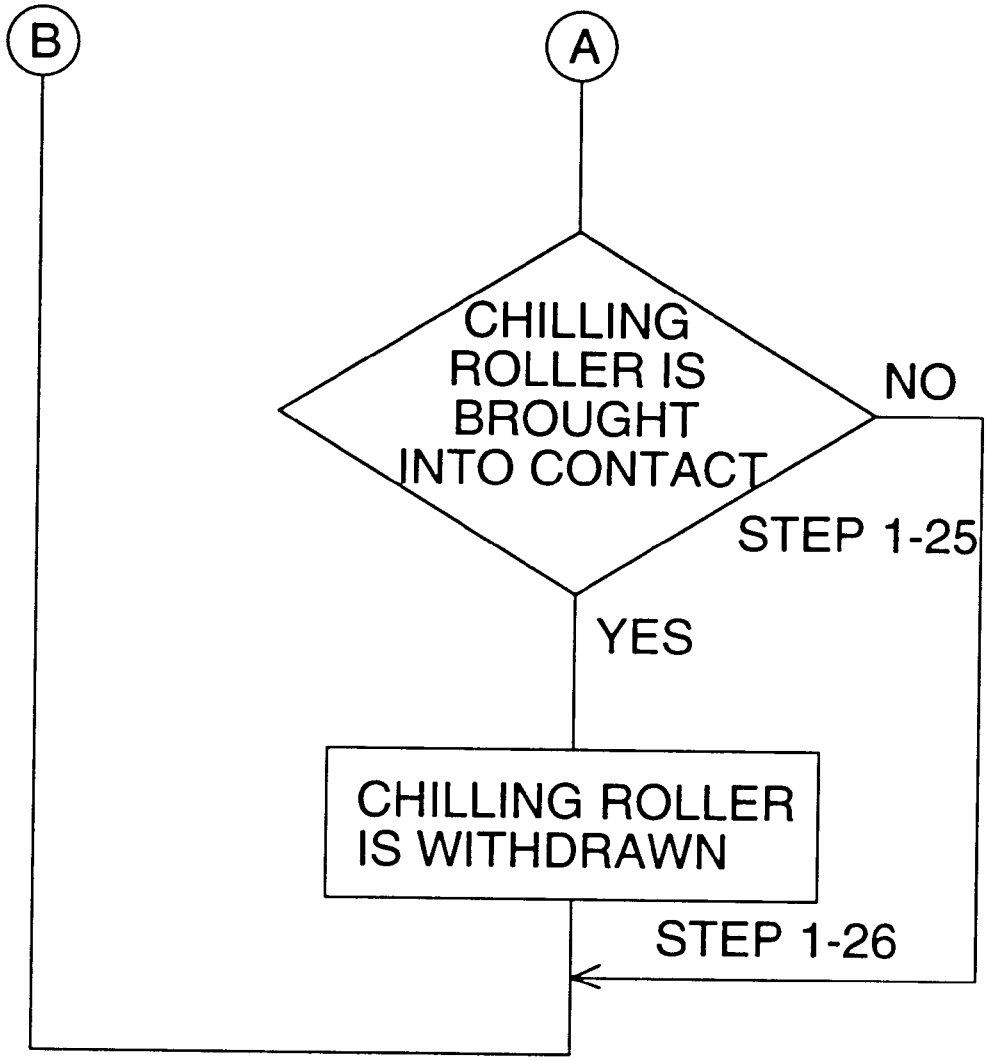
FIG. 7 shows a flow diagram showing control of the fixing device during copying operation in FIG. 1.

Next, operation of the fixing device having the above-mentioned constitution will be explained referring to FIGS. 5 through 7. FIG. 5(*a*) represents a flow diagram explaining an overall operation of the image forming apparatus. FIG. 5(*b*) is a flow diagram explaining warming up operation in FIG. 5(*a*). FIG. 5(*c*) is a flow diagram explaining idling operation in FIG. 5(*a*). FIGS. 6 and 7 respectively represent a flow diagram explaining operation of the fixing device when copying shown in FIG. 3.

First, using FIG. 5(*a*), overall operation of the image forming apparatus will be explained. When the power supply switch is turned ON, warming up, i.e., the temperature of heating roller 91 is raised to be the prescribed temperature is conducted (Step 1-1).

Wen warming up is completed, idling, i.e., an operation to maintain the temperature of heating roller 91 at a prescribed one is conducted (Steps 1-2 and 1-3).

When the copy button is turned ON, copying is conducted (Step 1-4). When copying is finished, the step is returned to Step 1-2. Until the next copy button is turned ON, idling is conducted.

Next, by the use of FIG. 5(*b*), operation during warming up will be explained. Control section 500 obtains information about temperature (t1) from first temperature detecting means 340. If temperature of heating roller 91 (t1) is lower than prescribed temperature (T), halogen heater lamp 210 is driven until the temperature is raised at prescribed temperature (T) or higher. When the temperature reaches the prescribed temperature (T) or higher, the driving stops.

Next, referring to FIG. 5(*c*), operation during idling will be explained. Control section 500 obtains information about temperature (t1) from first temperature detecting means 340 of heating roller 91. If temperature of heating roller 91 (t1) is lower than prescribed temperature (T), halogen heater lamp 210 is driven (Steps 1-7 and 1-8) until the temperature is raised at prescribed temperature (T) or higher. When reached it, the driving stops (Steps 1-7 and 1-9).

During idling, an operator inputs information about the size of recording paper (W) and information about the number of copying sheet (I) on the apparatus. If the copy button is turned ON, copying starts.

Next, referring to FIGS. 6 and 7, operation during copying will be explained.

Control section 500 reads information about the size of recording paper (W) and information about the number of copying sheet (I) (Step 1-10), and conducts copying for the number of copy set.

Here, controlling operation is significantly different between when the size of recording paper P passed (W) is larger than the size determined prescribedly (W) and when it is lower than the size determined prescribedly (Step 1-11).

If the size of recording paper P passed (W) is larger than the size determined prescribedly (W), at a certain cycle, information about the temperature from first temperature detection means 340 (t1) is obtained (Step 1-12). Halogen heater lamp 210 is caused to be actuated in such a manner that temperature (T) set of heating roller 91 is the same or higher than set temperature (T) (Steps 1-13, 1-14 and 1-15). Copying for the set number of sheet (I) is conducted (Step 1-16), and return to Step 1-2 in FIG. 5(*a*).

On the other hand, if the size of recording paper P passed (W) is smaller than the size determined prescribedly (W), at a certain cycle, control section 500 obtains information about the temperature from first and second temperature detection means 340 and 341 (t1 and t2) (Step 1-17). If the temperature of non-passing portion (Lout) (t2) is higher than the prescribed one, solenoid 405 is actuated so that cooling roller 350 is brought into contact with heating roller 91 (Steps 1-18 and 1-19). In addition, if the temperature of the non-passing portion (Lout) (t2) is at the prescribed temperature or less, solenoid 405 is actuated so that cooling roller 350 is withdrawn from heating roller 91 (Steps 1-18 and 1-20). In addition, halogen heater lamp 210 is caused to be actuated in such a manner that the temperature of heating roller 91 (t1) is at the set one (T) or higher (Steps 1-21, 1-22 and 1-23). Thus, copying for set number of sheets (I) is conducted (Step 1-24).

There may be cases in which cooling roller 350 is brought into contact with heating roller 91 when copying for the set number of sheets is finished (Step 1-19). In this occasion, cooling roller 350 is withdrawn from heating roller 91 (Steps 1-25 and 1-26), and return to Step 1-2 in FIG. 5(*a*).

According to the above-mentioned constitution, control means 500 obtains information about the size of recording paper (W). If a recording paper conducting image formation is smaller than the prescribed size, due to that cooling roller 350 is caused to be brought into contact/withdrawn from heating roller 91 and that the temperature of non-passing portion (Lout) is not raised compared with prescribed temperature (TO), temperature rise in the non-passing portion (Lout) of heating roller 91 can be prevented.

The layer thickness of fluorine resin layer 353 formed on the outer circumference of cooling roller 350, functioning as a cooling member, is thin. Therefore, aforesaid fluorine resin layer 353 can be regarded as an elastic material layer in combination with silicone rubber layer 352. Contacting area between heating roller 91 and cooling roller 350 becomes wide. Accordingly, cooling of non-passing portion (Lout) of heating roller 350 can be conducted.

Accordingly, the occurrence of the hot offset can be prevented. In addition, rise of the temperature of non-passing portion (Lout) can be prevented. Therefore, life of parts in the vicinity of the heating roller can be extended. Due to setting that the contact angle by means of the parting mterial on the surface of cooling roller 350 being larger than the contact angle by means of the release material on the surface of heating roller 91, contamination on heating roller 91 becomes difficult to adhere on cooling roller 350 since parting property of cooling roller 350 is superior to heating roller 91.

Accordingly, contamination is not laminated on the surface of cooling roller 350. Contact with heating roller 91 is constantly maintained, and cooling efficiency is not reduced.

In addition, since contamination laminated is peeled off, fixed images are not contaminated.

If cooling is not necessary, heated cooling roller 350 can abruptly be cooled due to separating cooling roller 350 from heating roller 91. Cooling effects are not reduced and, in addition, adhesion of contamination from the heating roller can be reduced.

Figure 9:
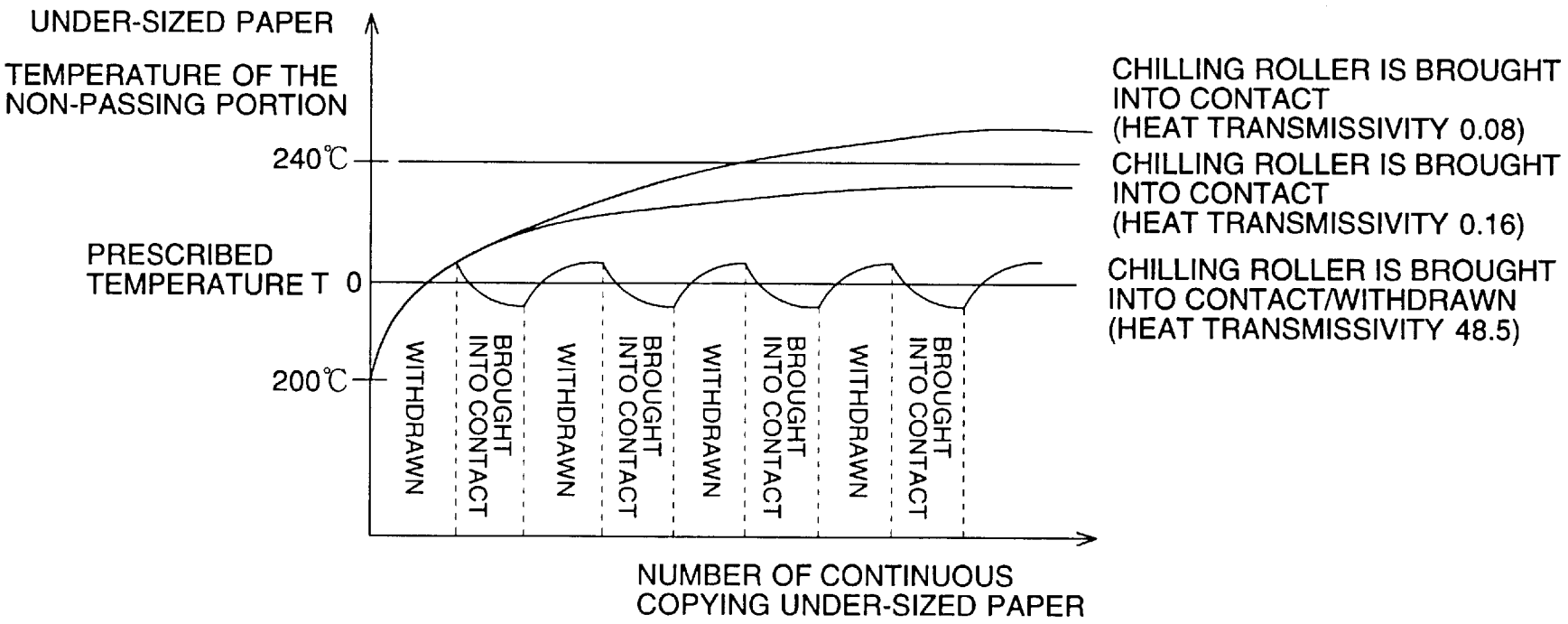
FIG. 9 shows a drawing explaining effects of the second embodiment and the third embodiment.

In order to confirm the effects of the above-mentioned first through third embodiments, the present inventors studied the change of temperature in the non-passing portion (Lout) when recording papers having small size were continuously copied, when cooling rollers made of PET in which the heat conductivity of the surface materials were respectively 0.08 W/mK and 0.16 W/mK were constantly brought into contact with heating rollers as shown in the first and the second embodiment and when cooling roller 350 made of carbon steel whose transmission ratio was 48.5 W/mK was brought into contact/withdrawn with heating roller 91. FIG. 9 shows the reslts thereof.

As is understood from FIG. 9, if cooling roller 350 was constantly brought into contact with heating roller 91, it was confirmed that the temperature of the non-passing portion (Lout) can be maintained at 240° C. (which is the hot offset occurrence temperature) or less even when copying is conducted continuously, provided that the heat conductivity on the surface of the cooling roller.

As in the third Embodiment, if cooling roller 350 is brought into contact/withdrawn on heating roller 91, it was confirmed that the temperature of the non-passing portion (Lout) in the vicinity of the prescribed temperature (TO: 220° C.) set lower than 240° C. (which is the hot offset occurrence temperature).

Fourth Embodiment

Figure 10:
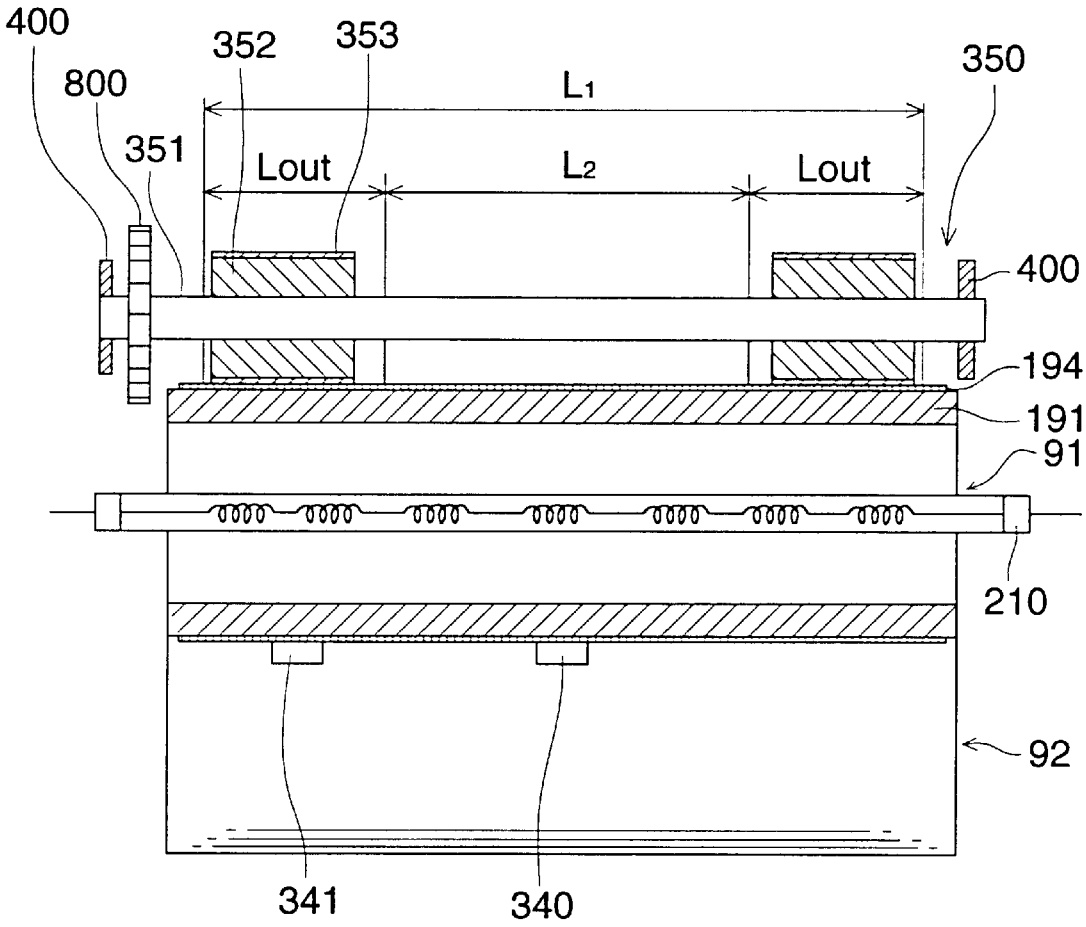
FIG. 10 shows a block digram of the fixing device of the fourth embodiment, and is a cross sectional view at cutting line A—A in FIG. 8.

Next, the first embodiment will be explained referring to FIGS. 10 through 15. FIG. 10 shows a cross sectional view of the fixing device of the fourth embodiment. Parts having the same numbers as those in the fixing device of FIG. 1 is so structured to be iexplained in the first embodiment.

In FIG. 10, numeral 340 represents the first temperature detecting means which detects temperature (t1) of the passing region on heating roller 91 for a recording paper with the minimum size. Numeral 341 represents the second temperature detecting means which detects temperature (t2) of the non-passing region (Lout) on heating roller 91.

Figure 11:
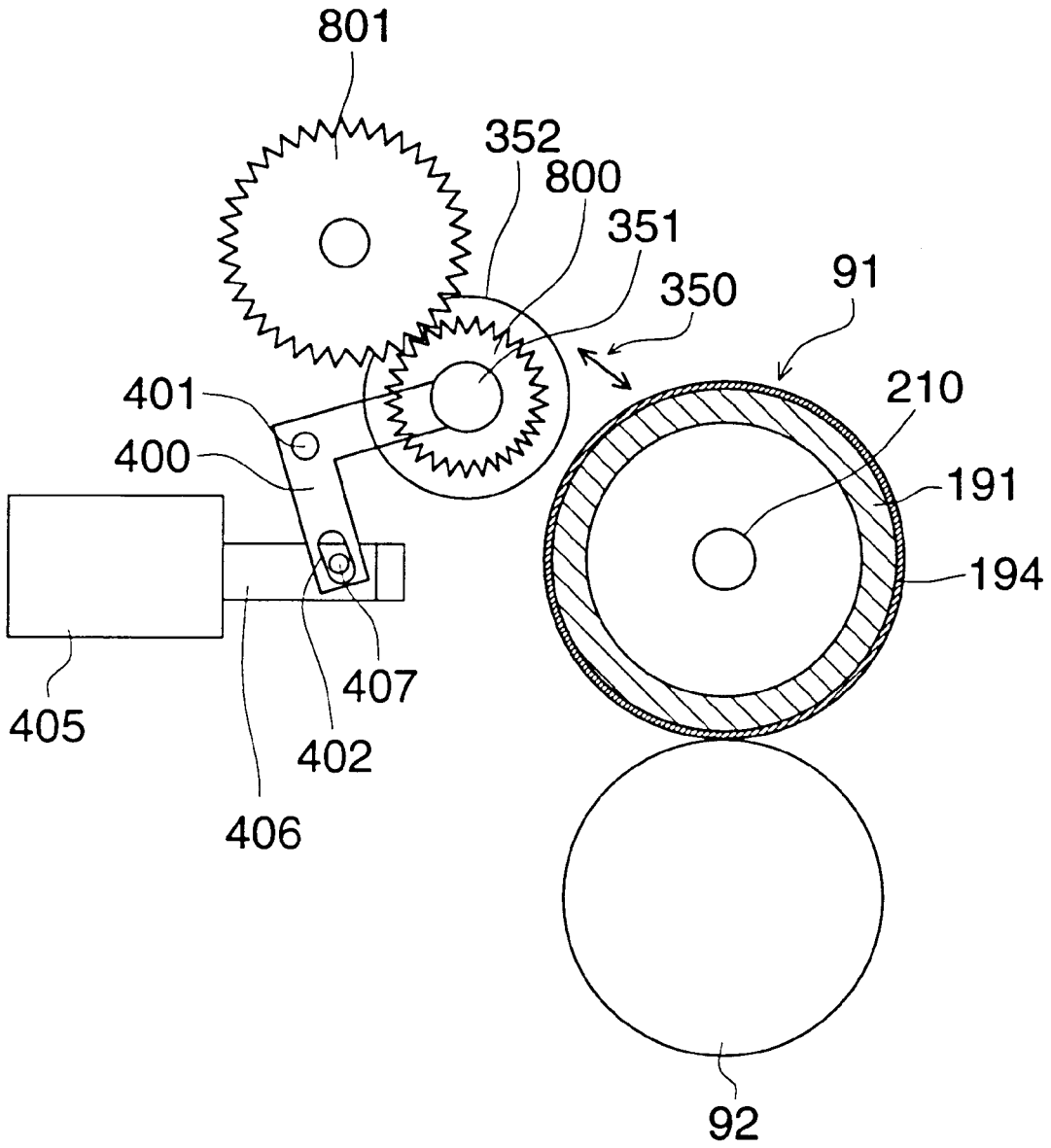
FIG. 11 shows left side view in FIG. 10.

Referring to FIG. 11, a mechanism in which chiling roller 350 is brought into contact/separate on heating roller 91 will be explained.

In FIG. 11, numeral 400 is an approximately L-shape lever rotatably provided on pin 401. At one end of aforesaid lever 400, shaft 351 of cooling roller 350 is fixed. At the other end, elongated hole 402 is provided.

Pin 407 provided on spindle 406 on solenoid 405 is engaged with elongated hole 402 of lever 400.

Accordingly, due to driving solenoid 405, lever 400 rotates with pin 401 as the center. Silicone rubber layer 352 on cooling roller 350 is controlled to contact/separate from the non-passing portion (Lout) of heating roller 91.

In addition, on shaft 351, first gear 800 is mounted.

When silicone rubber layer 352 on cooling roller 350 is withdrawn from heating roller 91, first gear 800 is engaged with second gear 801 which is rotated by auxiliary cooling motor 344 (not illustrated).

Figure 12:
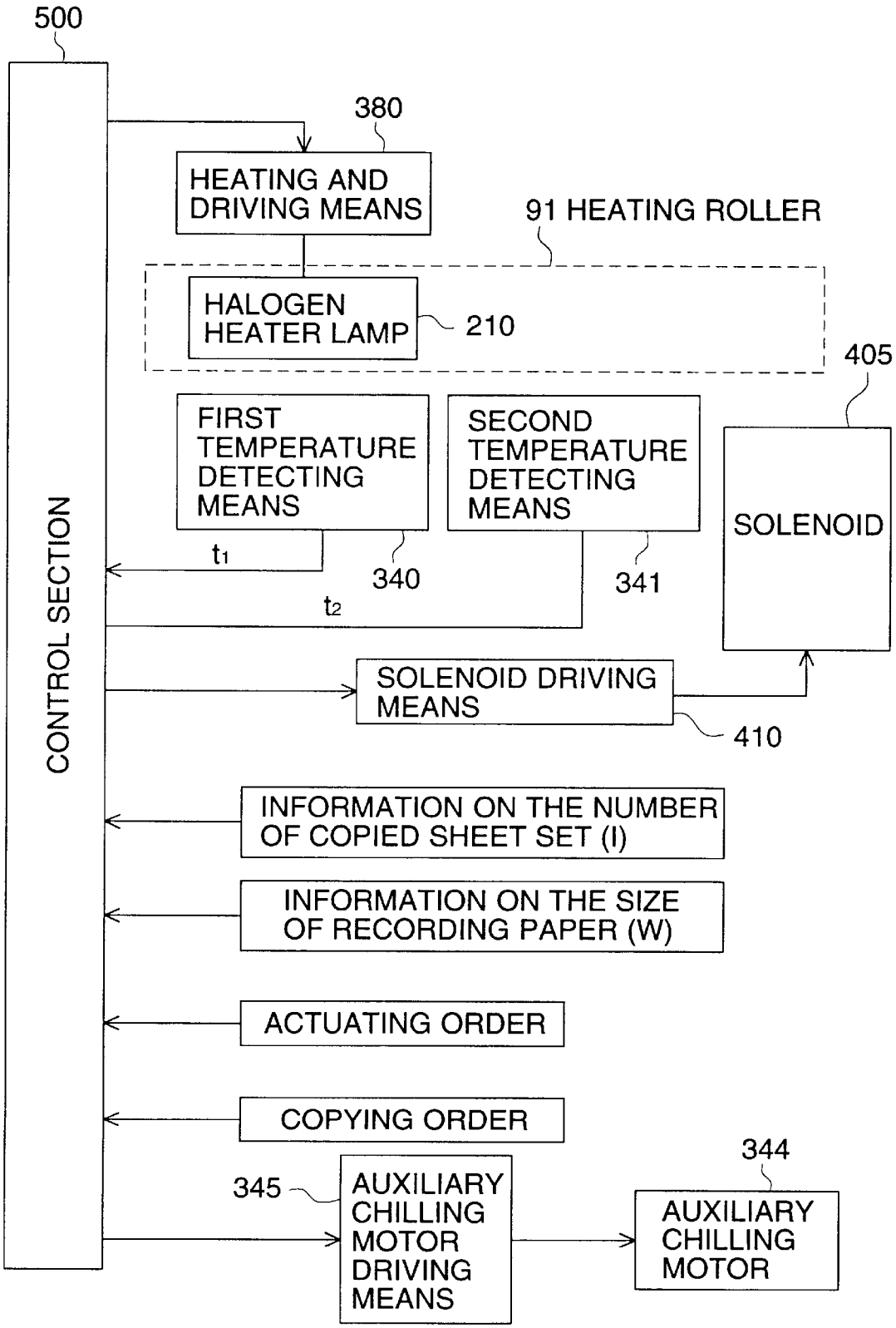
FIG. 12 shows a block diagram explaining electrical constitution of the fixing device shown in FIG. 10.

FIG. 12 shows a block diagram explaining electrical constitution of the fixing device shown in FIG. 10.

Control section 500 of the fourth embodiment, having the same function as control section 500 of the third embodiment, further actuates auxiliary cooling motor 344 through auxiliary cooling motor driving means 345.

Figure 13:
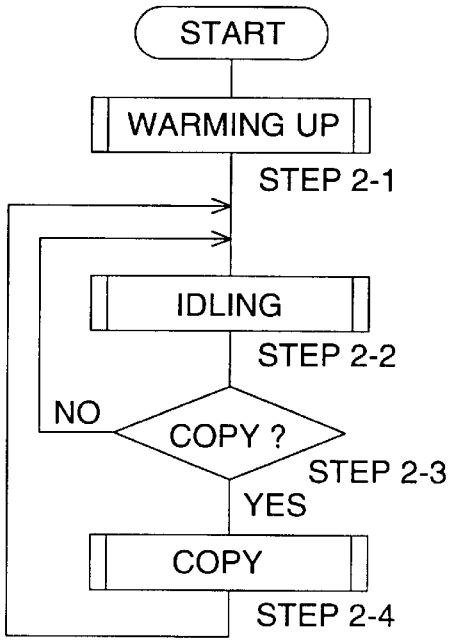
FIG. 13(*a*) shows a flow diagram explaining overall explanation of an image forming apparatus, FIG. 13(*b*) shows a flow diagram explaning warming up operation in FIG. 13(*a*) and FIG. 13(*c*) shows a flow diagram explaining idling operation in FIG. 13(*b*).
Figure 13:
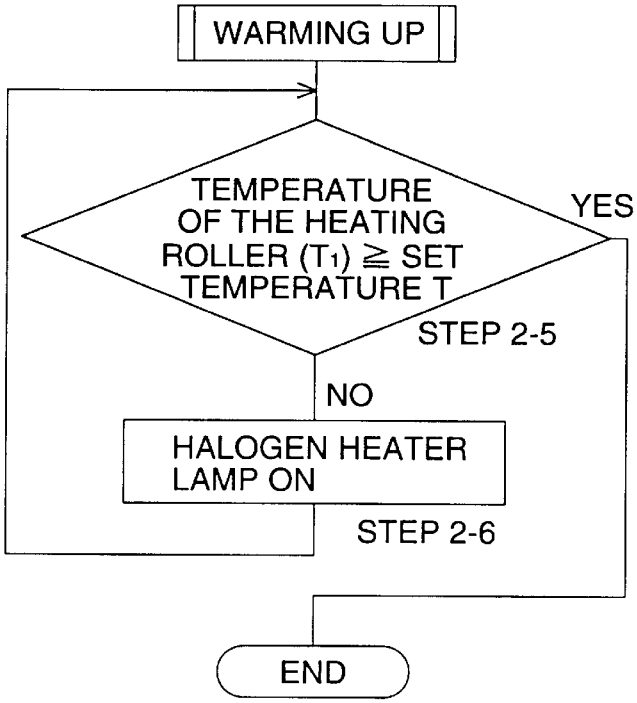
Figure 13:
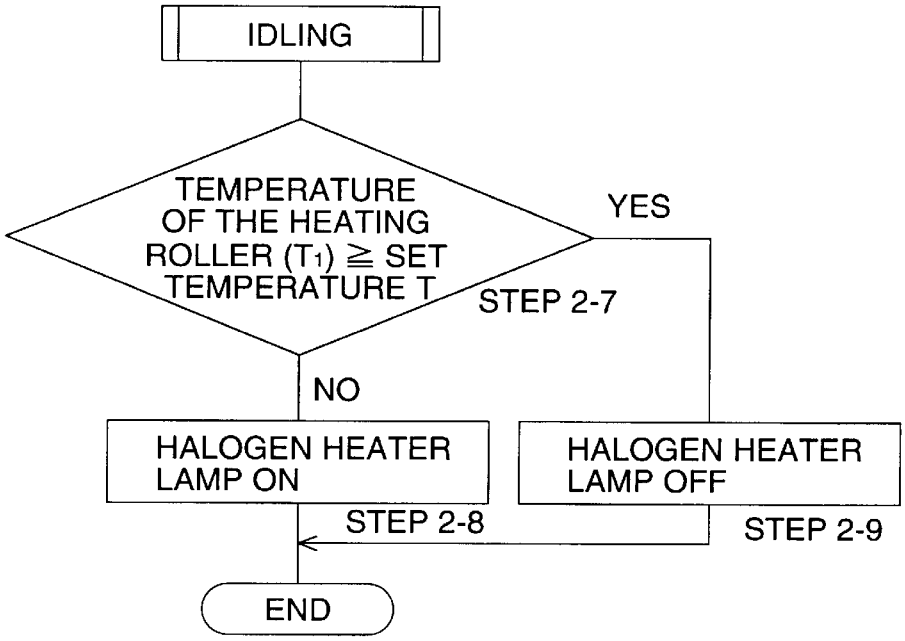

Operation of the fixing device of the fourth embodiment will be explained referring to FIG. 13 through 15. FIG. 13(*a*) shows a flow diagram explaining overall explanation of an image forming apparatus, FIG. 13(*b*) shows a flow diagram explaning warming up operation in FIG. 13(*a*) and FIG. 13(*c*) shows a flow diagram explaining idling operation in FIG. 13(*b*).

Figure 14:
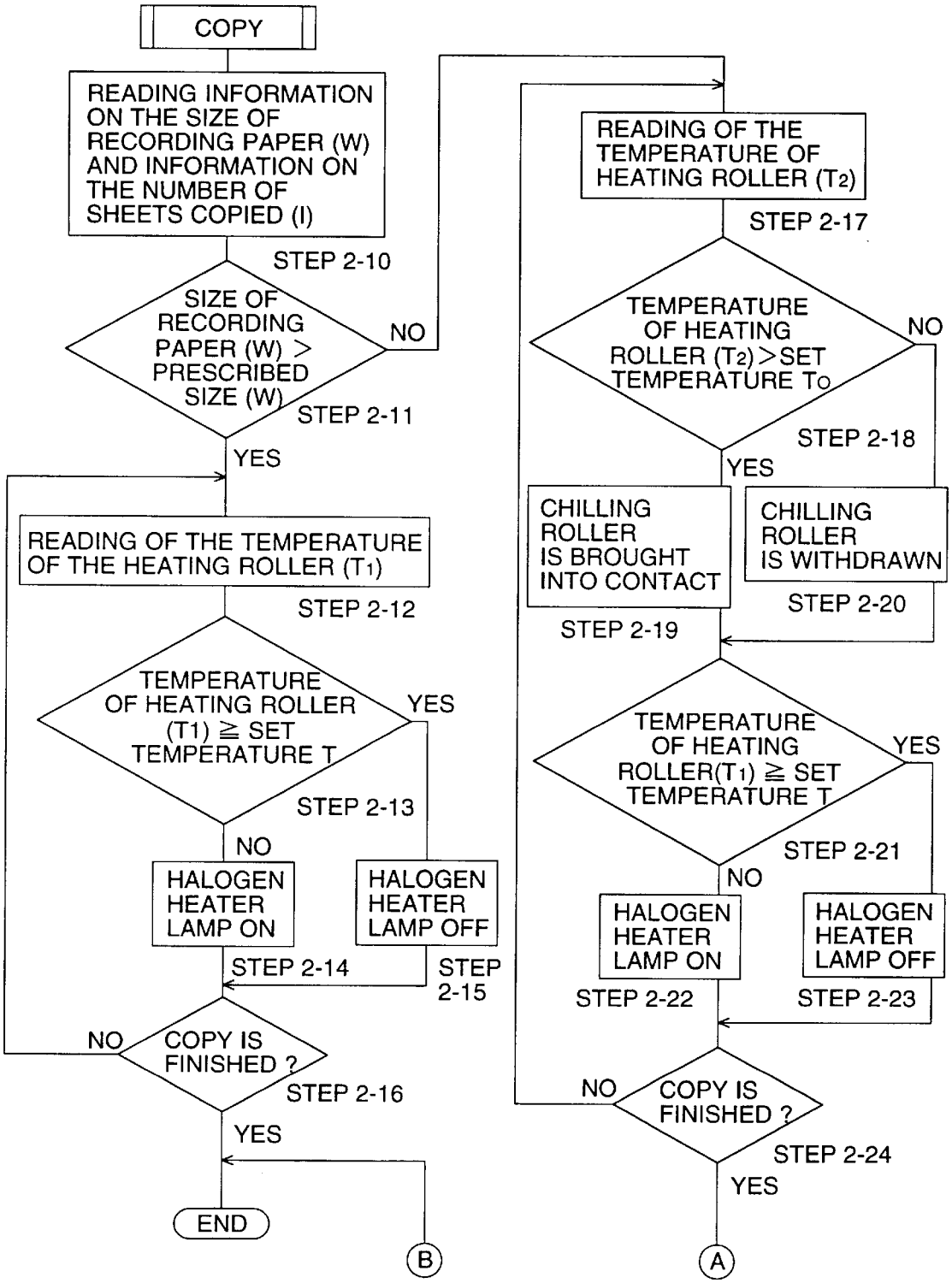
FIG. 14 shows a flow diagram showing control of the fixing device during copying operation in FIG. 10.
Figure 15:
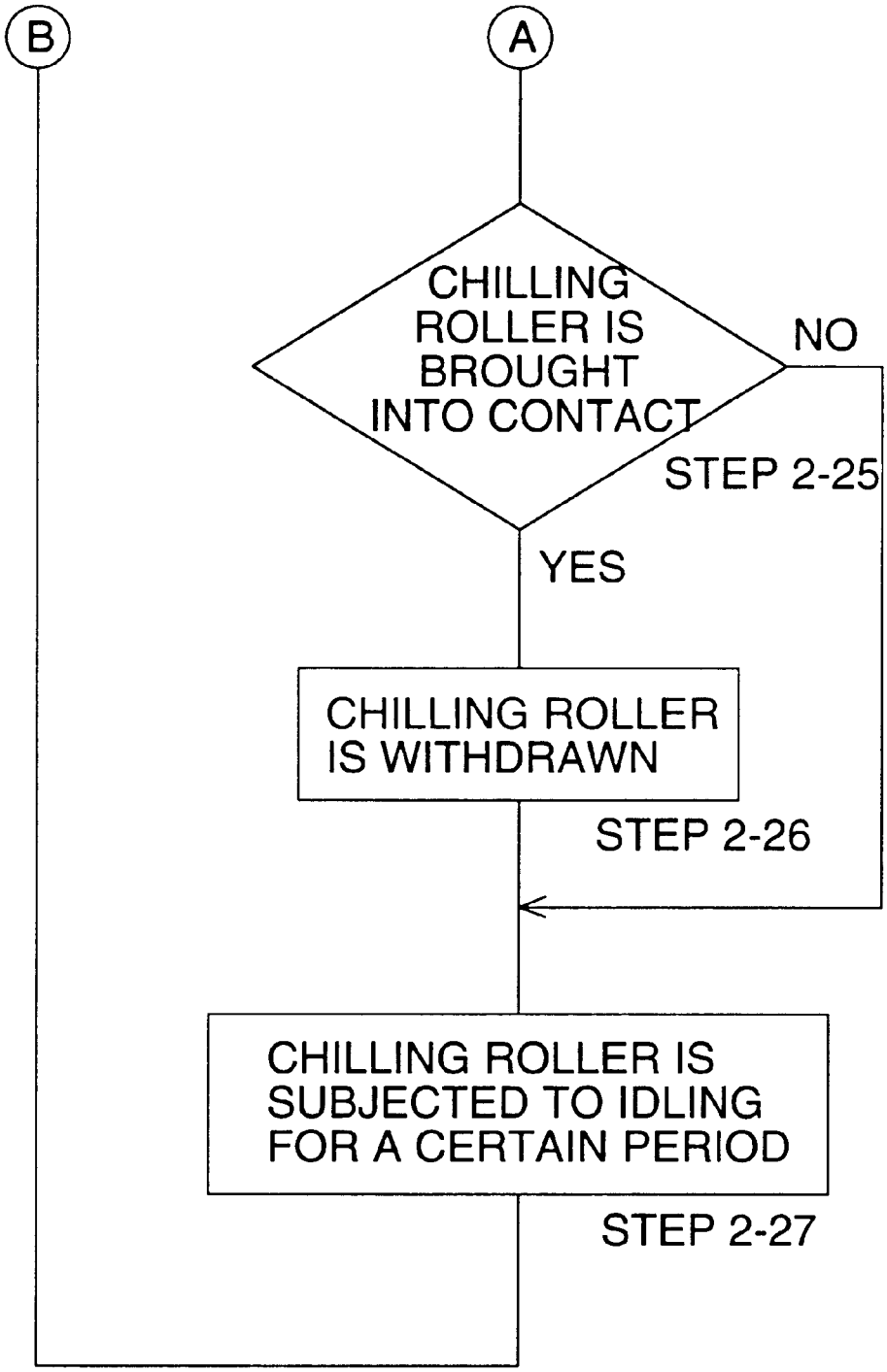
FIG. 15 shows a flow diagram showing control of the fixing device during copying operation in FIG. 10.

FIGS. 14 and 15 respectively show a flow diagram showing control of the fixing device during copying operation in FIG. 10.

In FIGS. 13(*a*), 13(*b*), 13(*c*), 14 and 15, Steps through 2-1 through 2-26 provide the same operation as Steps 1-1 trough 1-26 in FIGS. 5(*a*), 5(*b*), 5(*c*), 6 and 7 in the first embodiment.

In the fourth embodiment, after cooling roller 350 is withdrawn from heating roller 91 in Step 2-26, auxiliary cooling motor 344 is actuated so that cooling roller 350 is subjected to idling for a prscribed time. Then, return to Step 2-2 in FIG. 13(*a*).

In the fourth embodiment, when fixing is finished, auxiliary cooling motor 344, which is an auxiliary cooling means, is actuated so that cooling roller 350 is subjected to idling rotation. Due to this, cooling roller 350 is cooled.

Accordingly, even if recording papers whose size is smaller than the prescribed size are continuously copied, cooling roller 350 is cooled. Therefore, the rise of the temperature of non-passing portion of heating roller 91 can be prevented. Hot offset is difficult to occur. Accordingly, durability of parts in the vicinity of the heating roller 91 can be maintained.

Fifth Embodiment

Figure 16:
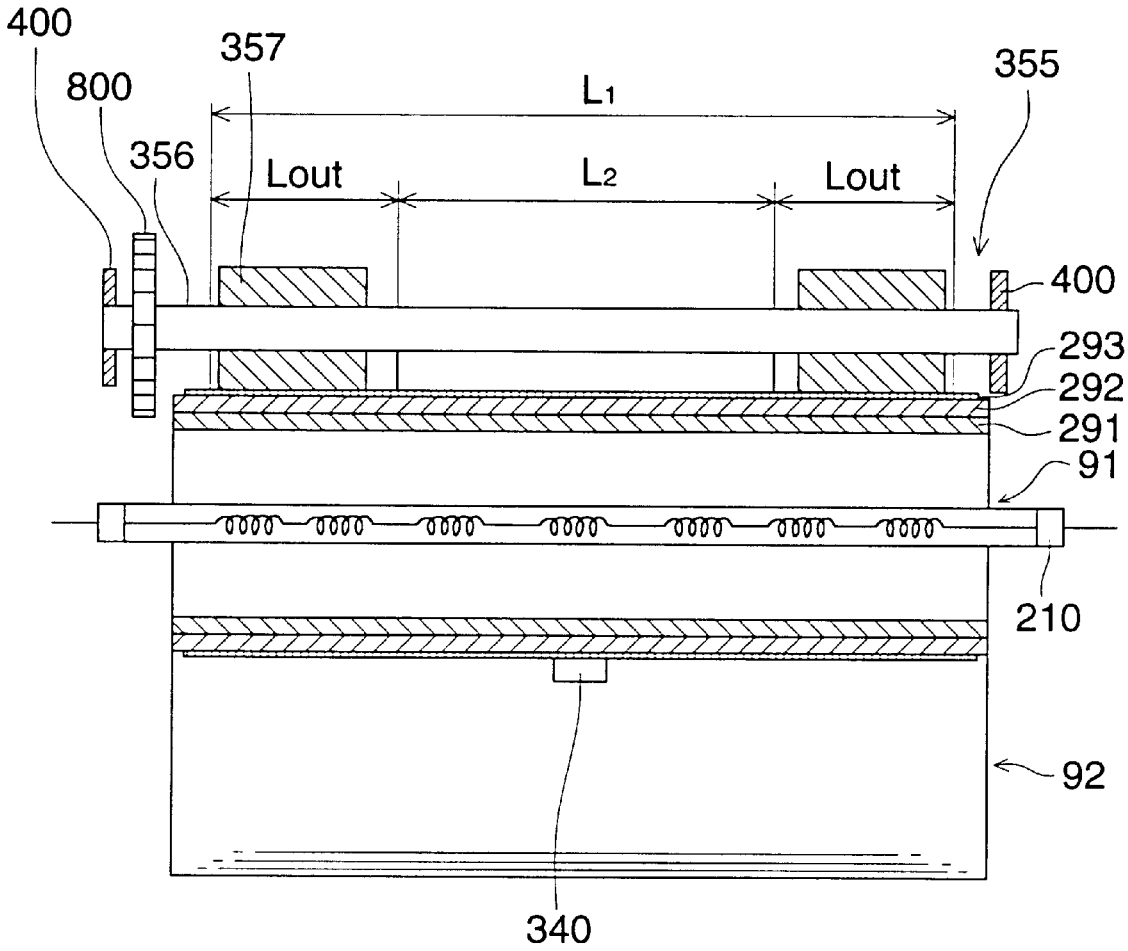
FIG. 16 shows a block digram of the fixing device of the fifth embodiment, and is a cross sectional view at cutting line A—A in FIG. 8.
Figure 17:
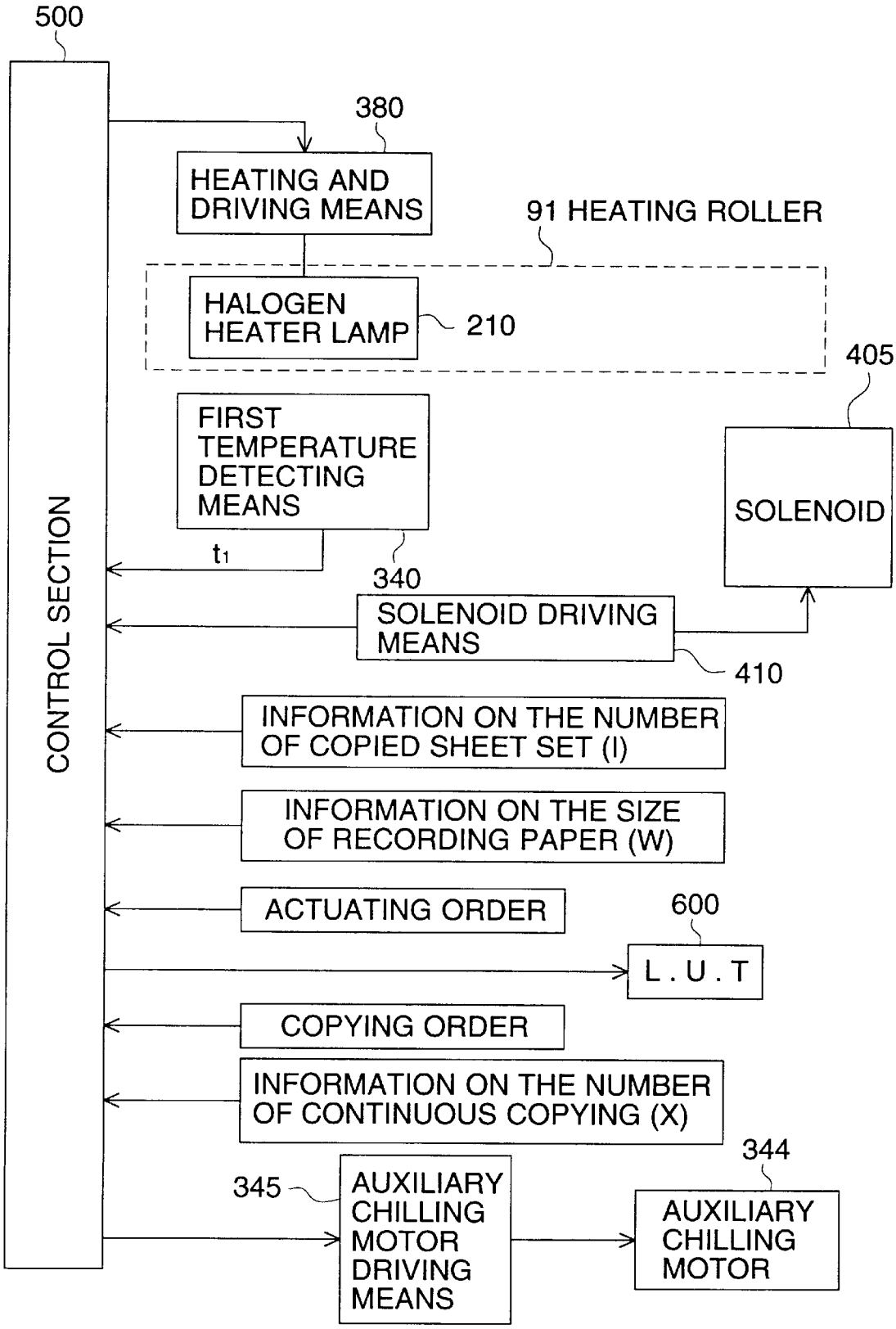
FIG. 17 shows a block diagram explaining electrical constitution of the fixing device shown in FIG. 16.

Next, the second embodiment will be explained referring to FIGS. 16 through 20. FIG. 16 shows a cross sectional view of the fixing device of the fifth embodiment. This fixing device is so structured to be iexplained in the second embodiment. With regard to identical portions between the present embodiment and the second embodiment, identical numerals are affixed. Their explnation will be omitted.

Control section 500 of the fifth embodiment, having the same function as control section of the fourth embodiment, further actuates auxiliary cooling motor 344 through auxiliary cooling motor driving means 345.

On contol section of the fifth embodiment, look-up table 600 is provided.

As shown in FIG. 18(*a*), look-up table 600 memorizes relationship between the size of the recording paper and cooling means contacting starting sheet number (i). As the width of the recording paper is narrow, volume of colory not absorbed by recording paper P on non-passing portion (Lout) is large. Rise of the temperature of non-passing portion (Lout) becomes larger. Hot offset occurs earlier. Cooling means contacting starting sheet number (i) becomes earlier.

In addition, as shown in FIG. 18(*b*), aforesaid look-up table also memorizes relationship between copying number set when the cooling roller is subjected to idling after copying is finished and the time for idling of the cooling roller.

Figure 19:
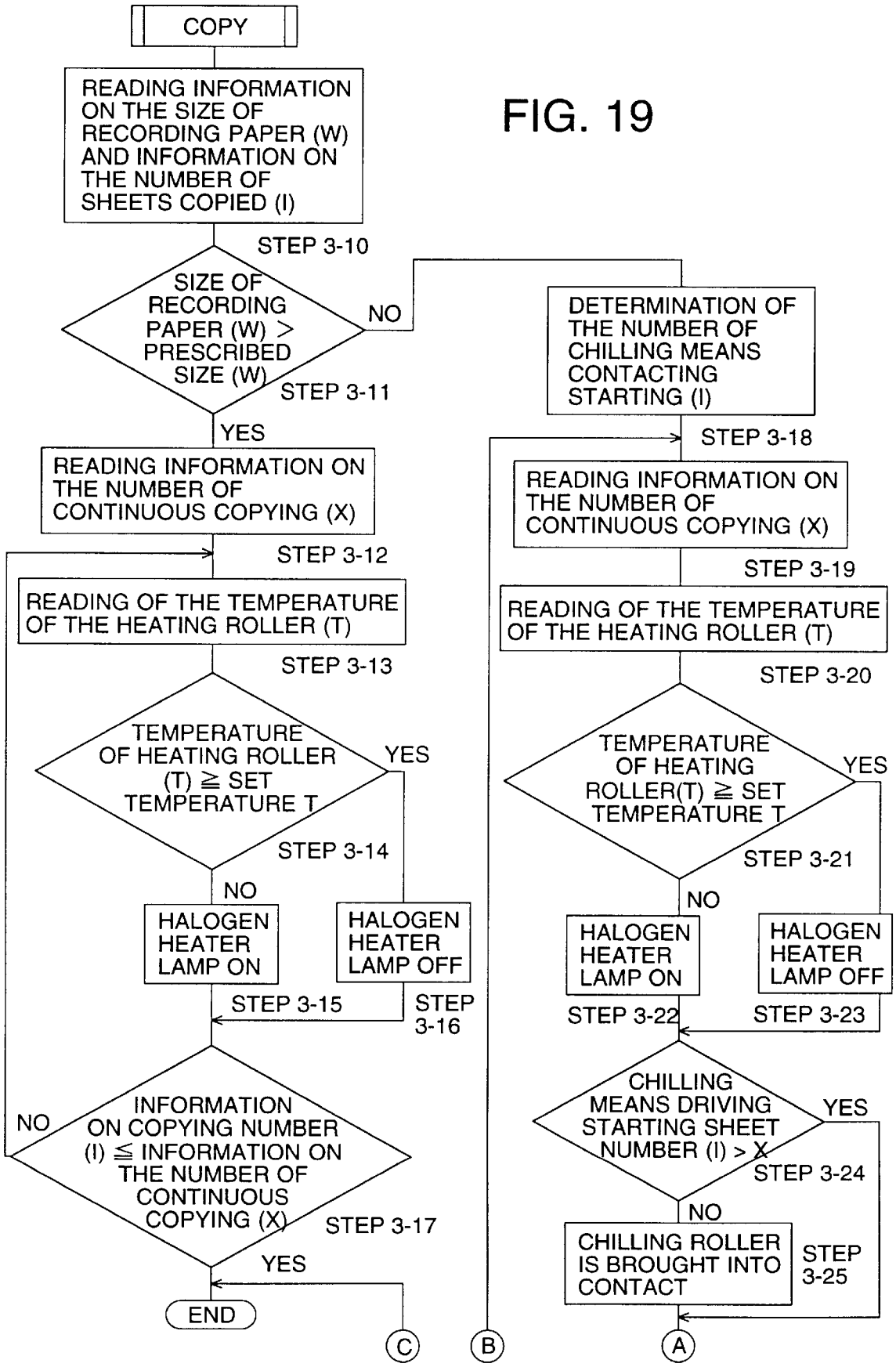
FIG. 19 shows a flow diagram showing control of the fixing device during copying operation in FIG. 16.
Figure 20:
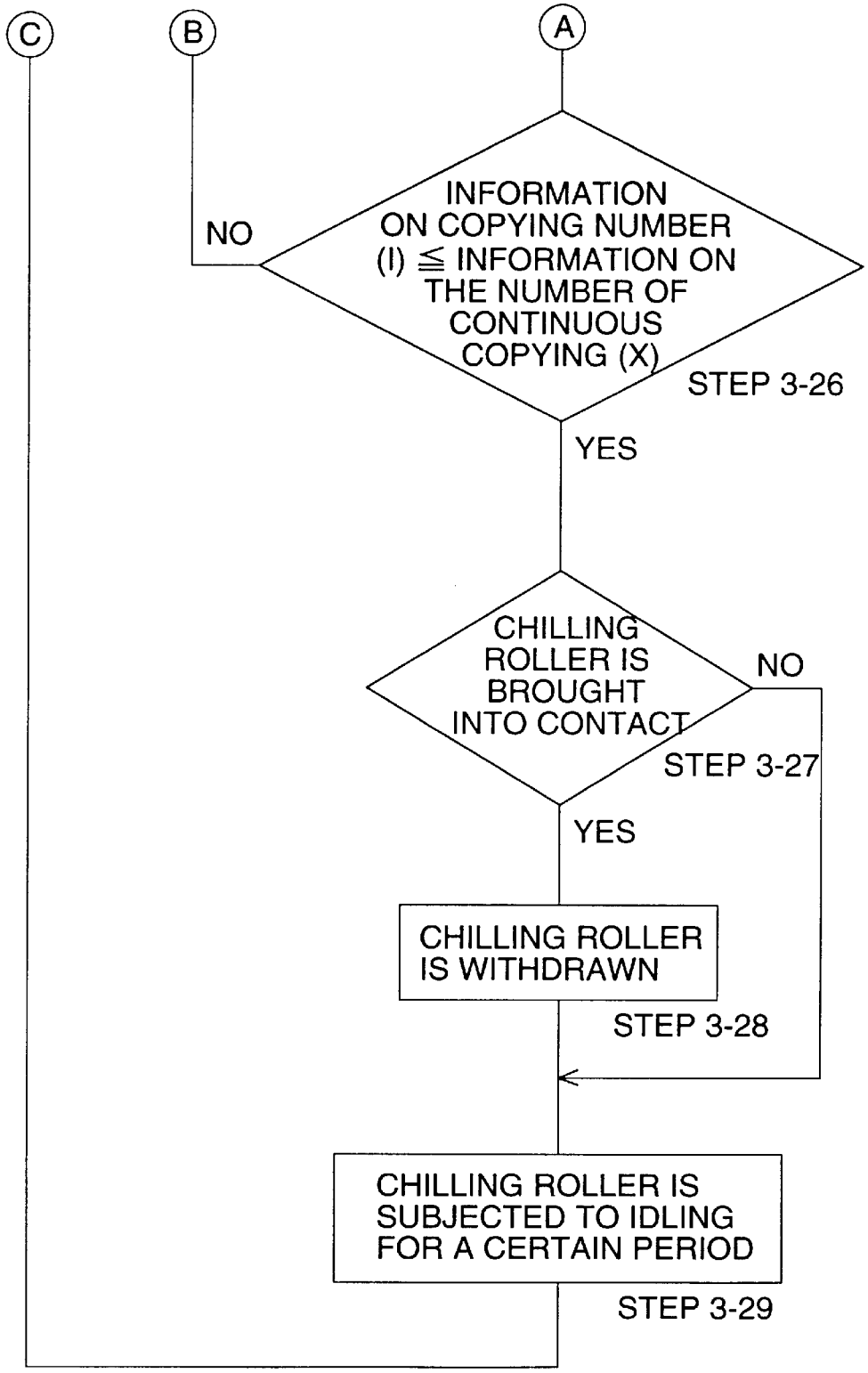
FIG. 20 shows a flow diagram showing control of the fixing device during copying operation in FIG. 16.

Next, operation of the fixing device having the above-mentioned constitution will be exlained referring to FIGS. 19 and 20. Incidentally, points different between the fourth embodiment and the present embodiment lies in operation during copying. Other points are identical. Therefore, only operation during copying operation is explained.

Control means 500 obtains information about the size of recording paper (W) and information about the umber of copying (I) (Step 3-10), and copying for the set number of sheet will be conducted.

Here, contol operation is noticeably different between a case when the size of recording paper P passed (W) is larger than the prescribed size determined in advance (W) and a case when the size of recording paper P passed (W) is the same as the prescribed size (W) or smaller (Step 11).

If the size of recording paper P passed (W) is larger than the size determined prescribedly (W) (Step 3-12), at a certain cycle, information about the temperature from first temperature detection means 340 (t1) is obtained (Step 3-13). Halogen heater lamp 210 is caused to be actuated in such a manner that temperature (T) set of heating roller 91 is the same or higher than set temperature (T) (Steps 3-14, 3-15 and 3-16). Copying for the set number of sheet (I) is conducted (Step 17), and return to Step 2-2 in FIG. 13(*a*).

On the other hand, if the size of recording paper P passed (W) is the same as or smaller than the size determined prescribedly, referring to table 600, control section 500 determines cooling means contacting starting sheet number (i) (Step 3-18).

Next, at a certain cycle, information about the number o sheets copied continuously (x) is read (Step 3-19) and temperature information (t) from temperature detecting means 340 is obtained (Step 3-20). In such a manner that the temperature of heating roller 91 becomes set temperature (T) or higher, halogen heater lamp 210 is actuated (Step 3-21, 3-22 and 3-23). On and after cooling means contacting starting sheet number (i), cooling roller 355 is brought into contact with heating roller 91 (Steps 3-24 and 3-25).

When copying for the set sheet number is finished (Step 3-26), there may be cases that cooling roller 355 is brought into contact with heating roller 91 (Step 3-25). In such cases, cooling roller 355 is withdrawn from heating roller 91 (Steps 3-27 and 3-28).

Referring to look-up table 600, idling time of cooling roller 350 is determined. Auxiliary cooling motor 344 is driven. Cooling roller 350 is subjected to idling for a prescribed time (Step 3-29). Then, return to Step 2 in FIG. 13(*a*).

Due to the above-mentioned constitution, control means 500 obtains information from the transfer sheet size selection means. If the recording paper on which images are formed is smaller than the prescribed size, in copying on and after cooling means contacting starting sheet number (i), rise of the temperature of the non-passing portion (Lout) of heating roller 91 is prevented due to contacting cooling roller 355 with heating roller 91.

When fixing is finished, auxiliary cooling motor 344, which is an auxiliary cooling means, is driven so that cooling roller 355 is subjected to idling. Thus, cooling roller 355 is cooled.

Accordingly, since cooling roller 355 is cooled even when a recording paper whose size is smaller than the prescribed size is continuously copied successively, the rise of the temperature of non-passing region of heating roller 91 can be prevented. Accordingly, hot offset is dificult to occur and durability of parts in the vicinity of the heating roller can be maintained.

In addition, look-up table 600 memorizes relationship between set copy number and the idling time for the cooling roller. Due to this, idling time for cooling roller 355 has been determined in accordance with the set copy number. Accordingly, cooling roller 355 can be determined surely. In addition, there is no waste idling. Therefore, energy saving is attained.

Sixth Embodiment

Figure 21:
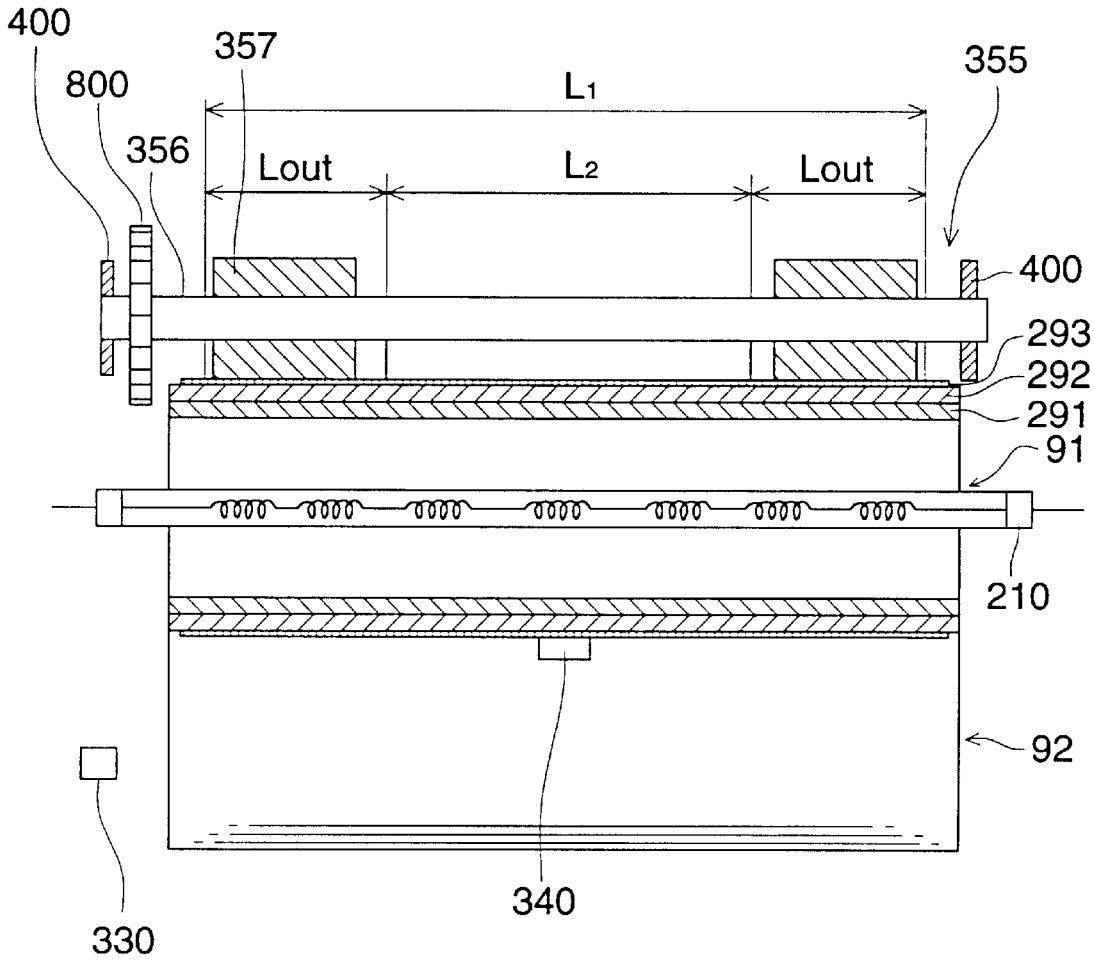
FIG. 21 shows a block digram of the fixing device of the fifth embodiment, and is a cross sectional view at cutting line A—A in FIG. 3.

Next, referring to FIGS. 21 and 22, mechanical and electrical constitution of the heating roller in the fixing device of the image forming apparatus of the sixth embodiment will be explained. FIG. 21 shows a cross sectioal vie of the fixing device of the present embodiment. FIG. 22 shows a block diagram explaining an electrical constitution of the fixing device shown in FIG. 21.

With regard to identical portions between the sixth embodiment and the fifth embodiment shown in FIG. 16, identical numerals are affixed. Their explnation will be omitted. The different point between the present embodiment and the fifth embodiment is whether or not there is ambient temperature detecting means 330 which detects temperature (t') inside the apparatus.

Figure 23:
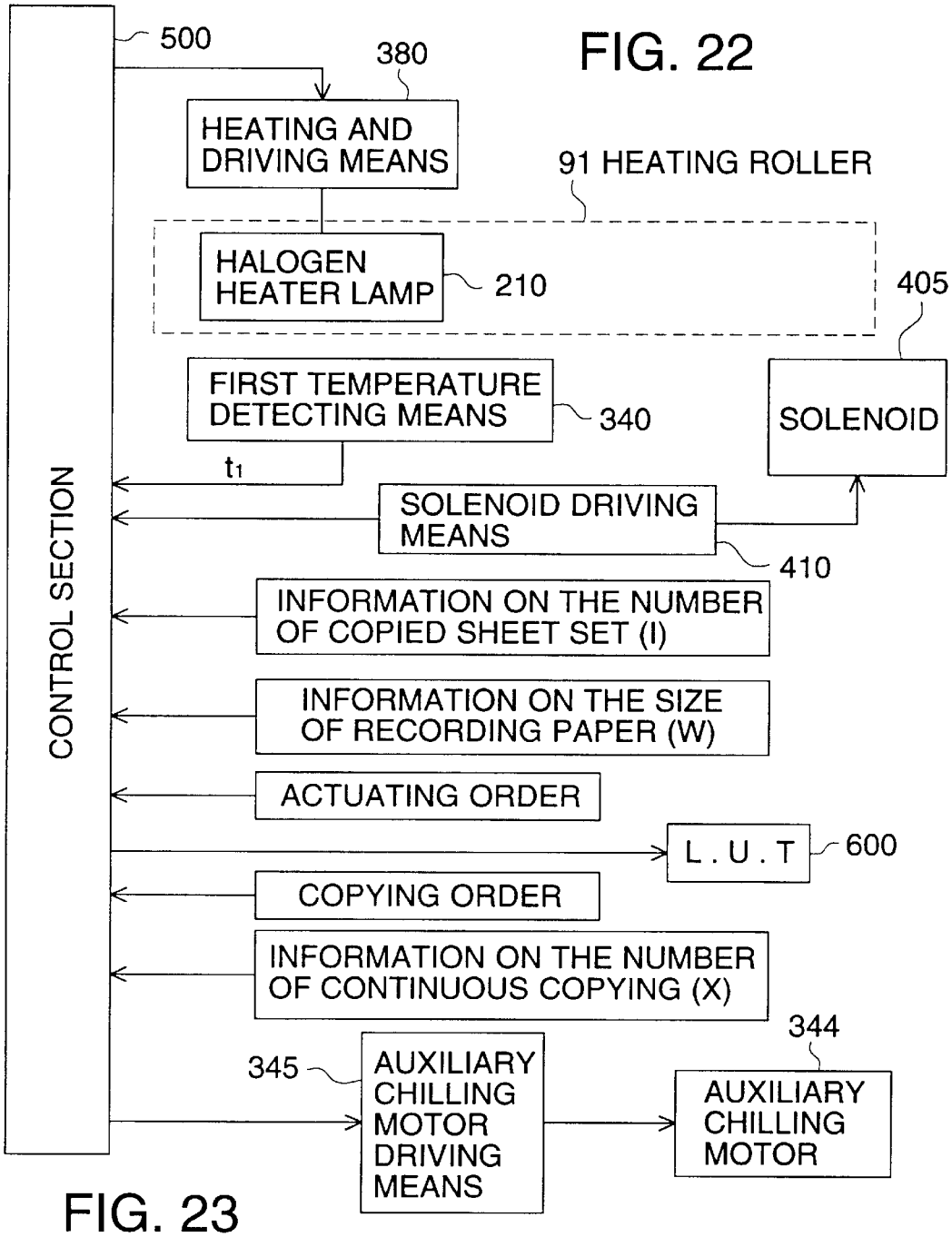
FIG. 23 shows a drawing explaining information recorded om the look-up table shown in FIG. 22.
Figure 25:
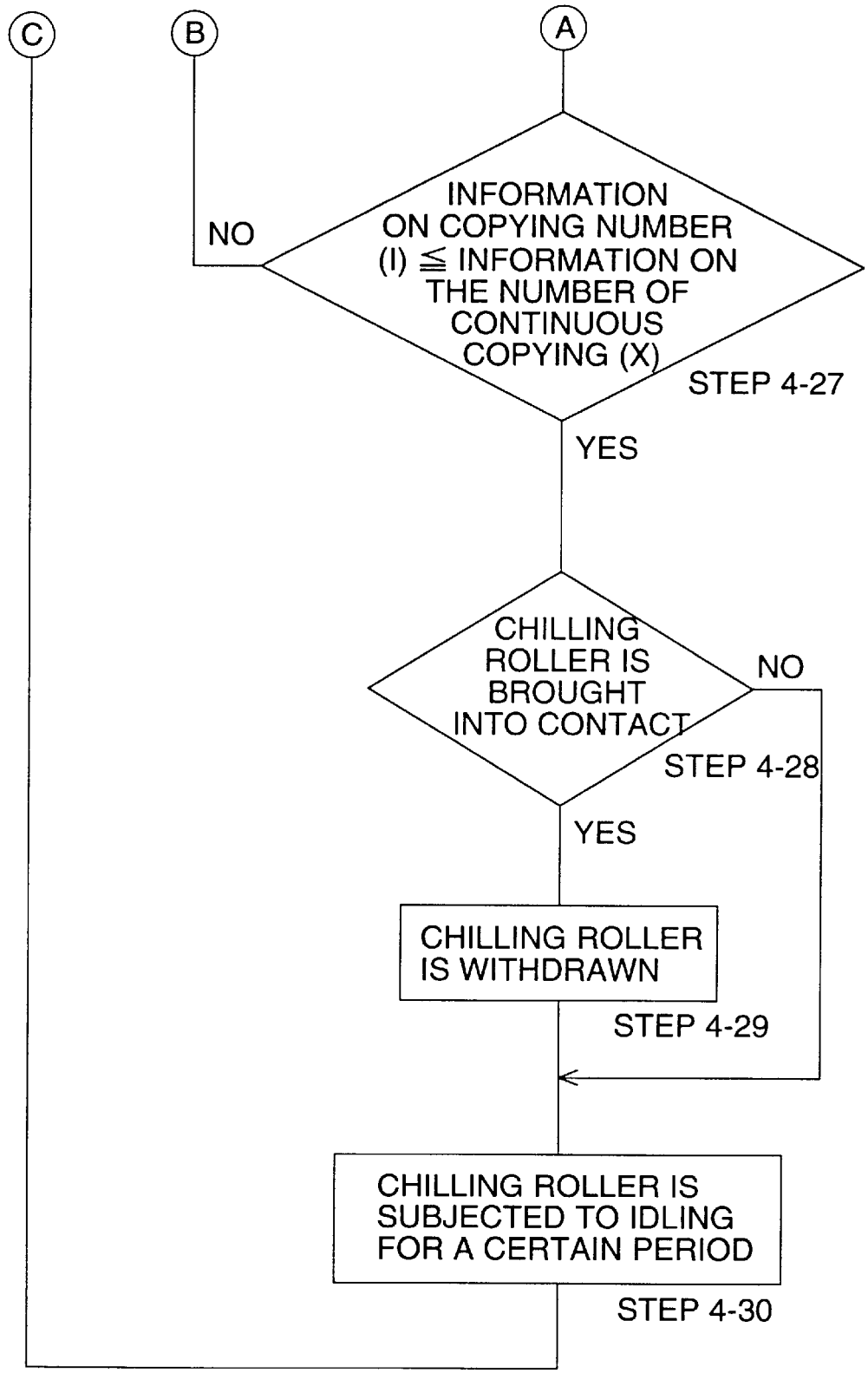
FIG. 25 shows a flow diagram showing control of the fixing device during copying operation in FIG. 22.

As shown in FIG. 23, table 600 of the sixth embodiment records relationship between the size of recording paper P and cooling means contacting starting sheet number (i) and ambient temperature (t'). Provided that the size of the recording paper is the same, the higher the temperature (t') inside the apparatus is, the higher the temperature of recording paper P is. Therefore, calory removed from heatng roller 91 when a paper is passed becomes small. Therefore, temperature difference with the temperature of non-passing portion L1 on heating roller 91 becomes small. As a result, cooling means contacting starting sheet number becomes delayed.

In addition, as shown in FIG. 18(*b*), in the same manner as in the fifth embodiment, aforesaid look-up table also memorizes relationship between copying number set when the cooling roller is subjected to idling after copying is finished and the time for idling of the cooling roller.

Incidentally, points different between the fourth embodiment and the present embodiment lies in operation during copying. Other points are identical. Therefore, only operation different from the fifth embodiment is explained, referring to FIGS. 15 and 16.

Control means 500 obtains information about the size of recording paper (W) and information about the number of copying (I) (Step 4-10), and copying for the set number of sheet will be conducted.

Here, contol operation is noticeably different between a case when the size of recording paper P passed (W) is larger than the prescribed size determined in advance (W) and a case when the size of recording paper P passed (W) is the same as the prescribed size (W) or smaller (Step 11).

If the size of recording paper P passed (w) is larger than the size determined prescribedly (W) (Step 3-12), at a certain cycle, information (x) about continuous copying sheet number is read (Step 4-12), and information about the temperature from first temperature detection means 340 (t) is obtained (Step 4-13). Halogen heater lamp 210 is caused to be actuated in such a manner that temperature (T) set of heating roller 91 is the same or higher than set temperature (T) (Steps 4-14, 4-15 and 4-16). Copying for the set number of sheet (I) is conducted (Step 4-17), and return to Step 2-2 in FIG. 13(*a*).

On the other hand, if the size of recording paper P passed (W) is the same as or smaller than the size determined prescribedly, referring to table 600, control section 500 determines cooling means contacting starting sheet number (i) (Step 4-19).

Next, at a certain cycle, information about the number of sheets copied continuously (x) is read (Step 4-20) and temperature information (t) from temperature detecting means 340 is obtained (Step 4-21). In such a manner that the temperature of heating roller 91 becomes set temperature (T) or higher, halogen heater lamp 210 is actuated (Step 22, 23 and 24). On and after cooling means contacting starting sheet number (i), cooling roller 355 is brought into contact with heating roller 91 (Steps 4-25 and 4-26).

When copying for the set sheet number is finished (Step 4-27), there may be cases that cooling roller 355 is brought into contact with heating roller 91 (Step 4-26). In such cases, cooling roller 355 is withdrawn from heating roller 91 (Steps 4-28 and 4-29).

Referring to look-up table 600, idling time of cooling roller 350 is determined. Auxiliary cooling motor 344 is driven. Cooling roller 350 is subjected to idling for a prescribed time (Step 4-30). Then, return to Step 2-2 in FIG. 13(*a*).

Due to the above-mentioned constitution, control means 500 obtains information from the transfer sheet size selection means. If the recording paper on which images are formed is smaller than the prescribed size, in copying on and after cooling means contacting starting sheet number (i), rise of the temperature of the non-passing portion (Lout) of heating roller 91 is prevented due to contacting cooling roller 355 with heating roller 91.

In addition to the fifth embodiment, due to adding the relationship between cooling means driving stating number (i) and ambient temperature (t') to the table, cooling means contacting starting sheet number (i) can be determined more correctly. As a result, temperature change of heqating roller 91 in the axis direction can be minimal.

Incidentally, the present invention is not limited to the above-mentioned embodiments. In the above-mentioned embodiments, as the ambient condition, temperature inside the apparatus was used. However, humidity inside the apparatus may be used.

In such a case, if ambient humidity is low, moisture content in the transfer sheet is lowered. As a result, calory removed by the transfer sheet due to aeration of the moisture when heating is also reduced. Therefore, temperature rise of the area on the heating roller outside the passing of the transfer sheet of the prescribed size within passing area of the transfer sheet having the maximum size is reduced. Therefore, cooling means driving starting sheet number can be delayed.

The cooling means driving starting sheet number may be determined by the use of both temperature and humidity inside the table apparatus as the ambient conditions.

EXAMPLE

In order to confirm the effects of the above-mentioned fourth through sixth embodiments, the present inventors continuously copied under-sizedd recording papers when the cooling means is used and when not used, so that temperature of non-passing portion (Lout) of heating roller 91 was investigated.

(1) Fourth Embodiment

Figure 26:
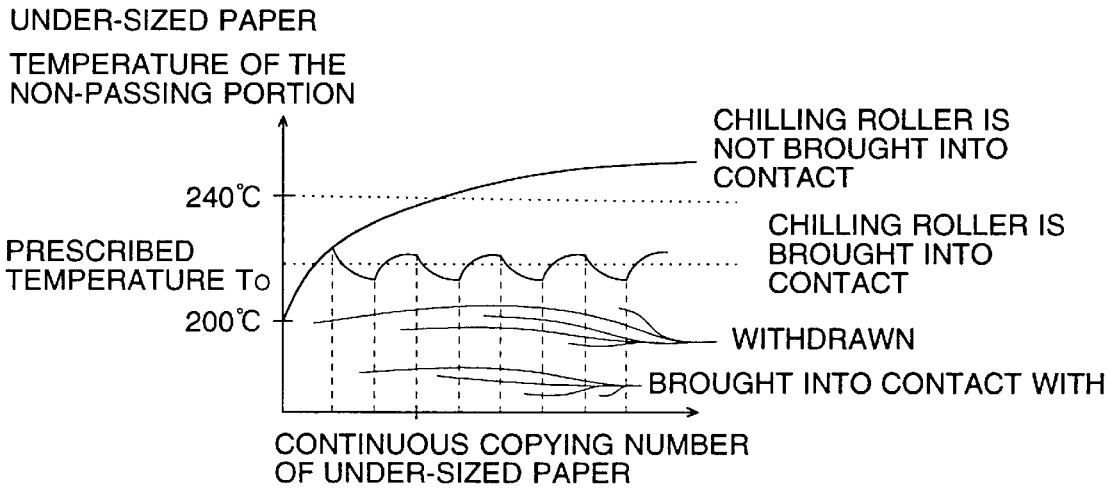
FIGS. 26(*a*) to 26(*c*) show a drawing explaining an Example.
Figure 26:
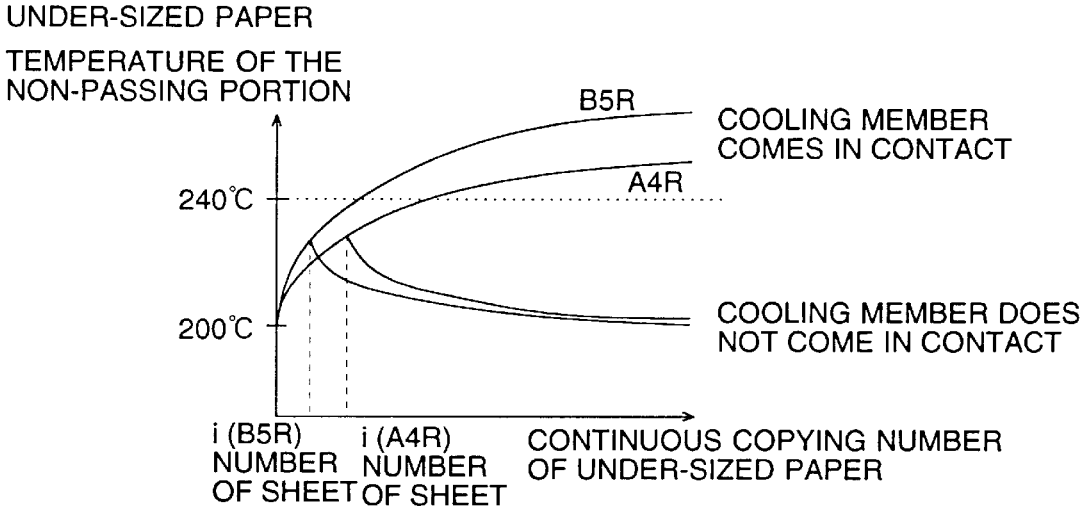
Figure 26:
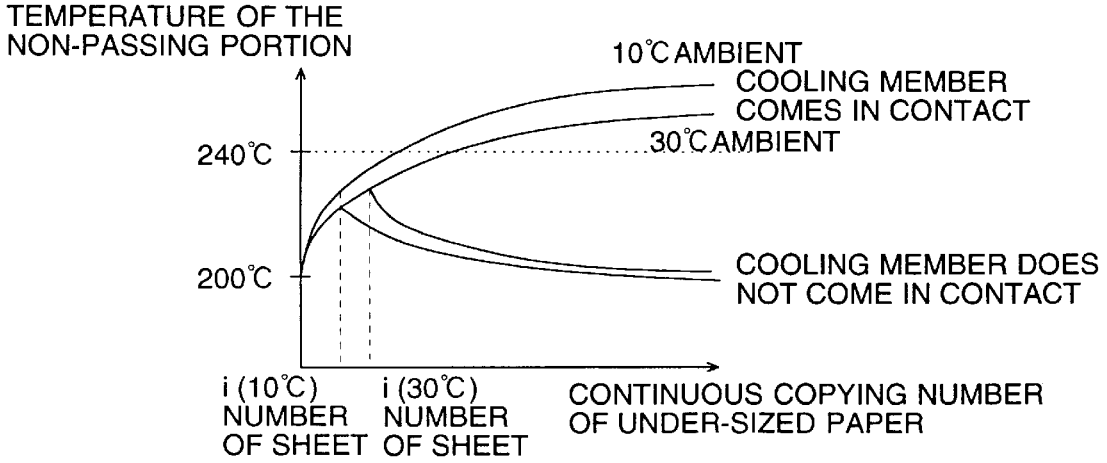
Figure 27:
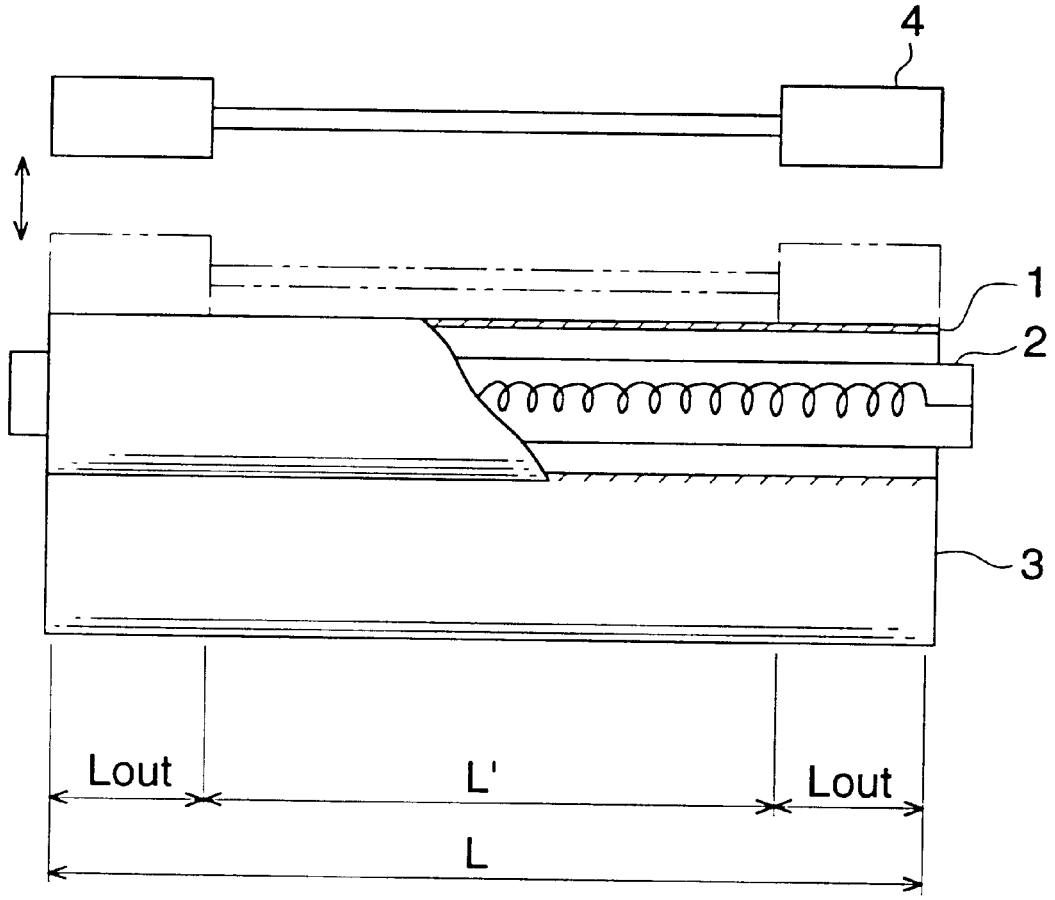
FIG. 27 PRIOR ART
FIG. 27 shows a drawing explaining a conventional example of a fixing device in which a cooling means is provided.

As shown in FIG. 26(*a*), it was confirmed that, if cooling roller 350 is brought into contact/withdrawn to/from heating roller 91, temperature in non-passing portion (Lout) remains in the vicinity of the prescribed temperature (TO: 220° C.) which has been set lower than 240° C. which is the temperature at which hot offset occurs.

(2) Second Embodiment

As shown in FIG. 26(*b*), it was confirmed that, if cooling roller 355 is brought into contact on heating roller 91 on and after cooling means contacting starting sheet number (i), the temperature is maintained at or lower than 240° C. which is the temperature at which hot offset occurs.

(3) Third Embodiment

As shown in FIG. 26(*b*), it was confirmed that, if cooling roller 355 is brought into contact on heating roller 91 on and after cooling means contacting starting sheet number (i), the temperature is maintained at or lower than 240° C. which is the temperature at which hot offset occurs.

Owing to the present invention, since the cooling roller, functioning as a cooling member, has an elastic layer on the outer circumference, the contact area between the heating roller and the cooling member is broadened. Accordingly, cooling of the heating roller can be conducted and the occurrence of hot offset can be prevented.

In addition, temperature rise of the area out of passing of under-sizedd transfer sheet can be prevented. Accordingly, life of parts in the vicinity of the heating roller is extended.

What is claimed is:

1. A device for fixing a toner image, comprising:

a heating roller including a heater, the heating roller having a length larger than a possible largest size sheet to be fixed so that the heating roller has an excess portion on which a small size sheet does not pass over;

a pressing roller for coming in contact with the heating roller; and a cooling roller for coming in contact with the excess portion of the heating roller so as to cool the excess portion;

wherein one of the heating roller and the cooling roller is a metal roller and the other one is a roller comprising an elastic material layer.

2. The device of claim 1, wherein the heat conductivity of the elastic material layer is 0.16 W/mK or more.

3. The device of claim 1, wherein the metal roller is covered with a first release material and the roller comprising the elastic material layer is covered with a second release material, and wherein the contact angle of the second release material is larger than that of the first release material.

4. The device of claim 1, wherein the cooling roller is adapted to come in contact with the heating roller or to move away from the heating roller.

5. The device of claim 1, further comprising:

auxiliary cooling means for cooling the cooling roller;

temperature detecting means for detecting a temperature of the excess portion of the heating roller;

size selecting means for selecting a size of a sheet to be fixed; and control means for receiving the selected size and for controlling such that when the selected size is smaller than a predetermined size, the control means receives the temperature of the excess portion, and when the temperature of the excess portion is higher than a predetermined temperature, the cooling roller is brought in contact with the heating roller, and that the cooling roller is cooled by the auxiliary cooling means after the fixing is finished.

6. The device of claim 5, wherein the auxiliary cooling means rotates the cooling roller when the cooling roller moves away from the heating roller.

7. The device of claim 1, further comprising:

auxiliary cooling means for cooling the cooling roller;

a table in which relationship between possible sizes of sheets and cooling start sheet numbers are recorded;

counting means for counting a number of fixed sheets;

size selecting means for selecting a size of sheet to be fixed; and control means for receiving the selected size and for controlling such that the cooling start sheet number for the selected size is determined with reference to the table when the selected size is smaller than a predetermined size and then the cooling roller is brought in contact with the excess portion of the heating roller when the counted number of fixed sheets becomes the cooling start sheet number, and that the cooling roller is cooled by the auxiliary cooling means after the fixing is finished.

8. The device of claim 7, wherein the auxiliary cooling means rotates the cooling roller when the cooling roller moves away from the heating roller.

9. The device of claim 1, further comprising:

auxiliary cooling means for cooling the cooling roller;

environmental condition detecting means for detecting an environmental condition in the device;

a table in which relationship among possible sizes of sheets, environmental conditions and cooling start sheet numbers are recorded;

counting means for counting a number of fixed sheets;

size selecting means for selecting a size of sheet to be fixed; and control means for receiving the selected size and for controling such that when the selected size is smaller than a predetermined size, the control means receives the environmental condition from the environmental condition detecting means and determines the cooling start sheet number with reference to the table and then the cooling roller is brought in contact with the excess portion of the heating roller when the counted number of fixed sheets becomes the cooling start sheet number, and that the cooling roller is cooled by the auxiliary cooling means after the fixing is finished.

10. The device of claim 9, wherein the environmental condition detecting means detects at least one of a temperature and a humidity.

11. The device of claim 9, wherein the auxiliary cooling means rotates the cooling roller when the cooling roller moves away from the heating roller.

* * * * *